US008445173B2

(12) United States Patent
Ohtani et al.

(10) Patent No.: US 8,445,173 B2
(45) Date of Patent: May 21, 2013

(54) METHOD OF PRODUCING HEAT-SENSITIVE TRANSFER IMAGE-RECEIVING SHEET HAVING A LENTICULAR LENS

(75) Inventors: Shigeaki Ohtani, Minami-ashigara (JP); Takashi Shimizu, Fujinomiya (JP)

(73) Assignee: Fujifilm Corporation, Tokyo (JP)

( * ) Notice: Subject to any disclaimer, the term of this patent is extended or adjusted under 35 U.S.C. 154(b) by 169 days.

(21) Appl. No.: 13/029,850

(22) Filed: Feb. 17, 2011

(65) Prior Publication Data

US 2011/0200934 A1 Aug. 18, 2011

(30) Foreign Application Priority Data

Feb. 18, 2010 (JP) ..... 2010-033840

(51) Int. Cl.
*G03C 8/00* (2006.01)
*B41M 5/00* (2006.01)

(52) U.S. Cl.
USPC ..... 430/200; 430/201; 428/32.39; 428/32.85; 428/32.6; 428/32.86; 428/32.64

(58) Field of Classification Search
USPC ..... 430/200, 201; 428/32.39, 32.85, 428/32.6, 32.86, 32.64
See application file for complete search history.

(56) References Cited

U.S. PATENT DOCUMENTS

| | | | | |
|---|---|---|---|---|
| 6,373,636 | B1 * | 4/2002 | Conley | 359/619 |
| 6,900,944 | B2 * | 5/2005 | Tomczyk | 359/619 |
| 7,212,346 | B2 * | 5/2007 | Krause | 359/619 |
| 7,786,039 | B2 * | 8/2010 | Koide et al. | 503/227 |
| 7,858,557 | B2 * | 12/2010 | Takehara | 503/227 |
| 7,863,218 | B2 * | 1/2011 | Yoshitani et al. | 503/227 |
| 7,863,219 | B2 * | 1/2011 | Arai et al. | 503/227 |
| 8,248,702 | B2 * | 8/2012 | Hoffman et al. | 359/621 |
| 2011/0064895 | A1 * | 3/2011 | Ohtani et al. | 428/32.39 |
| 2011/0183088 | A1 * | 7/2011 | Shimizu et al. | 428/32.39 |

FOREIGN PATENT DOCUMENTS

| | | | |
|---|---|---|---|
| JP | 06-282019 | | 10/1994 |
| JP | 09-300828 | | 11/1997 |
| JP | 3609065 | | 1/2005 |
| JP | 3789033 | | 6/2006 |
| JP | 2007190909 | A * | 8/2007 |
| JP | 2007230065 | A * | 9/2007 |
| JP | 2008-246949 | | 10/2008 |
| WO | WO 2007013649 | A1 * | 2/2007 |

OTHER PUBLICATIONS

Machine translation of JP 09-300828 (no date).*

* cited by examiner

*Primary Examiner* — Amanda C. Walke
(74) *Attorney, Agent, or Firm* — Young & Thompson

(57) ABSTRACT

A method of producing a heat-sensitive transfer image-receiving sheet, having the steps of: conveying a transparent support by web handling; providing at least one receptor layer on the transparent support; and drying the heat-sensitive transfer image-receiving sheet, in which the at least one receptor layer contains a latex polymer having a weighted average glass transition temperature of 30° C. or more, the heat-sensitive transfer image-receiving sheet is dried at a temperature that is higher than the weighted average glass transition temperature by 30° C. or more, and the heat-sensitive transfer image-receiving sheet has a lenticular lens on the side of the transparent support opposite to the side on which the receptor layer is provided.

10 Claims, 1 Drawing Sheet

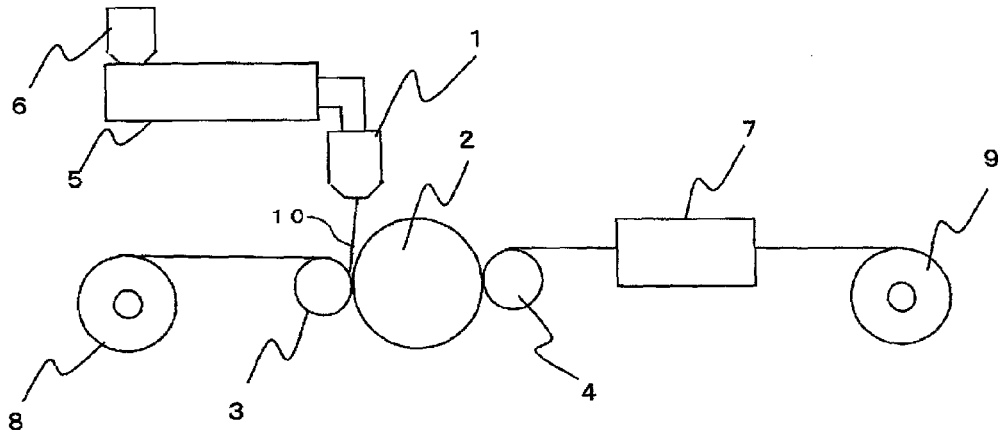
1
2
3
4
5
6
7
8
9
10

METHOD OF PRODUCING HEAT-SENSITIVE TRANSFER IMAGE-RECEIVING SHEET HAVING A LENTICULAR LENS

FIELD OF THE INVENTION

The present invention relates to a method of producing a heat-sensitive transfer image-receiving sheet having a lenticular lens, which is used for a dye diffusion transfer recording.

BACKGROUND OF THE INVENTION

In a dye diffusion transfer recording system (hereinafter also referred to as a sublimation transfer recording system), a heat-sensitive transfer sheet (hereinafter simply also referred to as an ink sheet) containing a colorant (hereinafter also referred to as a dye) is superposed on a heat-sensitive transfer image-receiving sheet (hereinafter simply also referred to as an image-receiving sheet), and then the heat-sensitive transfer sheet is heated by a thermal head whose exothermic action is controlled by electric signals, in order to transfer the dyes contained in the heat-sensitive transfer sheet to the image-receiving sheet, thereby recording an image information. Three colors: cyan, magenta, and yellow, or four colors which consist of the three colors and black are used for recording a color image by overlapping one color to other, thereby enabling transferring and recording a color image having continuous gradation for color densities.

On the other hand, in recent years, demands on color images are diversified, and there is a demand for obtaining three-dimensional images conveniently and inexpensively. It has been known that, so as to make a picture, a photograph, or the like appear stereoscopic, a lenticular lens (sheet-shaped, hereinafter also referred to as a lenticular lens sheet) formed from semi-cylindrical lenses is attached on a printed picture or photograph correspondingly to the right-side eye and the left-side eye. Along with the popularization of three-dimensional images, the three-dimensional images are required to be a stereoscopic image with accuracy, and to be a high grade image, free from an image defect, unevenness, and the like, like color images of other systems.

Japanese Patent No. 3609065 discloses an image recording apparatus equipped with a recording unit that records an image on the back side of the lenticular lens sheet, a moving mechanism for moving the recording unit and the lenticular lens sheet relatively to each other, a position detecting unit provided to be contacted with the concave parts and/or convex parts of the lenticular lens sheet, and a recording control unit that controls the recording unit to perform recording while detecting the position of the lenticular lens sheet by means of the position detecting unit.

Japanese Patent No. 3789033 and JP-A-9-300828 ("JP-A" means unexamined published Japanese patent application) discloses a method of producing a lenticular lens sheet printed material, including: preparing a heat transfer sheet provided with a coloring material transfer unit and a white layer transfer unit in area order on the same surface of a substrate film; thermally moving the coloring material from the coloring material transfer unit to the back surface of the lenticular lens sheet by using a heating device; and subsequently thermally transferring the white layer.

JP-A-6-282019 discloses a heat-sensitive transfer recording sheet for stereoscopic photographs, which utilizes the lenticular lens sheet as a substrate and has a dye receptor layer provided on the back side of the lenticular lens sheet.

JP-A-2008-246949 discloses that, in drying in a production of the heat-sensitive transfer sheet, a film surface temperature is kept in a range from 5° C. to 20° C. until drying of 60% of total water content is completed.

However, there is posed a new problem that when images are printed using such the lenticular lens sheet and the heat-sensitive transfer image-receiving sheet, a transfer failure in the form of black or colored spots occurs in middle or high-density image areas. This problem is prone to occur when the images are printed under high temperature and high humidity conditions, and thus it is strongly demanded to solve this problem.

SUMMARY OF THE INVENTION

The present resides in a method of producing a heat-sensitive transfer image-receiving sheet, comprising the steps of:

conveying a transparent support by web handling;

providing at least one receptor layer on the transparent support; and drying the heat-sensitive transfer image-receiving sheet, wherein said at least one receptor layer contains a latex polymer having a weighted average glass transition temperature of 30° C. or more, wherein the heat-sensitive transfer image-receiving sheet is dried at a temperature that is higher than the weighted average glass transition temperature by 30° C. or more, and wherein the heat-sensitive transfer image-receiving sheet has a lenticular lens on the side of the transparent support opposite to the side on which the receptor layer is provided.

Other and further features and advantages of the invention will appear more fully from the following description, appropriately referring to the accompanying drawing.

BRIEF DESCRIPTION OF THE DRAWING

FIG. 1 is an example of an overall process chart of an extrusion lamination equipment.

DETAILED DESCRIPTION OF THE INVENTION

According to the present invention, there are provided the following means:

(1) A method of producing a heat-sensitive transfer image-receiving sheet, comprising the steps of:

conveying a transparent support by web handling;

providing at least one receptor layer on the transparent support; and drying the heat-sensitive transfer image-receiving sheet, wherein said at least one receptor layer contains a latex polymer having a weighted average glass transition temperature of 30° C. or more, wherein the heat-sensitive transfer image-receiving sheet is dried at a temperature that is higher than the weighted average glass transition temperature by 30° C. or more, and wherein the heat-sensitive transfer image-receiving sheet has a lenticular lens on the side of the transparent support opposite to the side on which the receptor layer is provided.

(2) The method of producing a heat-sensitive transfer image-receiving sheet as described in the above item (1), wherein at least one of the latex polymer is a polymer containing a vinyl chloride component as a polymer constituting component.

(3) The method of producing a heat-sensitive transfer image-receiving sheet as described in the above item (1), wherein at least one of the latex polymer is a polyvinyl chloride or a vinyl chloride/acrylic copolymer.

(4) The method of producing a heat-sensitive transfer image-receiving sheet as described in any one of the above items (1) to (3), wherein the heat-sensitive transfer image-receiving sheet has a subbing layer which contains a resin that is identical with at least one resin constituting the lenticular lens, on the side of the transparent support opposite to the side on which the lenticular lens is provided, and wherein the heat-sensitive transfer image-receiving sheet has said at least one receptor layer on the subbing layer.

(5) The method of producing a heat-sensitive transfer image-receiving sheet as described in any one of the above items (1) to (4), wherein said at least one resin that constitutes the lenticular lens and/or the subbing layer is a polymethyl methacrylate resin, a polycarbonate resin, a polystyrene resin, a methacrylate-styrene copolymer resin, a polyethylene resin, a polyethylene terephthalate resin, or a glycol-modified polyethylene terephthalate resin.

(6) The method of producing a heat-sensitive transfer image-receiving sheet as described in any one of the above items (1) to (5), wherein the heat-sensitive transfer image-receiving sheet is dried at a temperature within a range from the weighted average glass transfer temperature of the latex polymer to a temperature less than 30° C. lower than the weighted average glass transfer temperature of the latex polymer, and then dried at a temperature of at least 30° C. higher than the weighted average glass transfer temperature of the latex polymer.

(7) The method of producing a heat-sensitive transfer image-receiving sheet as described in any one of the above items (1) to (6), wherein the weighted average glass transition temperature of the latex polymer is 40° C. to 100° C.

(8) The method of producing a heat-sensitive transfer image-receiving sheet as described in any one of the above items (1) to (7), wherein the receptor layer contains two or more kinds of the latex polymer.

(9) The method of producing a heat-sensitive transfer image-receiving sheet as described in any one of the above items (1) to (7), wherein the receptor layer contains two or more kinds of the latex polymer, each of which is polyvinyl chloride or vinyl chloride/acrylic copolymer.

(10) The method of producing a heat-sensitive transfer image-receiving sheet as described in any one of the above items (1) to (9), wherein the receptor layer does not contain gelatin and polyvinyl alcohol.

(11) The method of producing a heat-sensitive transfer image-receiving sheet as described in any one of the above items (1) to (10), wherein the receptor layer contains the latex polymer and at least one polyether-modified silicone represented by formula (S1):

Formula (S1)

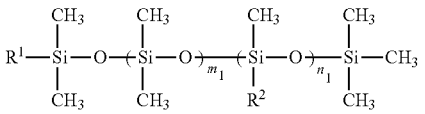

wherein $R^1$ represents an alkyl group; $R^2$ represents —X—$(C_2H_4O)_{a1}$—$(C_3H_6O)_{b1}$—$R^3$; $R^3$ represents a hydrogen atom, an acyl group, an alkyl group, a cycloalkyl group or an aryl group; X represents an alkylene group or an alkyleneoxy group; $m_1$ and $n_1$ each independently represents a positive integer; $a_1$ represents a positive integer; and $b_1$ represents 0 or a positive integer.

Hereinafter, the present invention will be described in detail. In the present specification, "to" denotes a range including numerical values described before and after it as a minimum value and a maximum value.

The heat-sensitive transfer image-receiving sheet of the present invention is explained in detail below.

<Heat-Sensitive Transfer Image-Receiving Sheet>

The heat-sensitive transfer image-receiving sheet of the present invention has a lenticular lens and at least one receptor layer on a transparent support, and may have a subbing layer composed of a resin that is identical with a resin constituting the lenticular lens, on the side of the transparent support that is opposite to the side on which the lenticular lens is provided.

[Support]

A support used in the present invention is a transparent support, and it is preferable that the transparent support has a sheet surface that is as smooth as possible. Further, the support is required to endure the heat of a melt and extruded resin sheet, and a polycarbonate resin, a polysulfone resin, a polyimide resin, a biaxially stretched polyethylene terephthalate resin and the like, which have relatively a high heat resistance, may be used for the support. Particularly, from the view point of well smoothness, a biaxially stretched polyethylene terephthalate resin is preferable.

Further, in order to make a resin for forming the subbing layer and the lenticular lens more rigidly adhere to the transparent support, it is particularly preferable that an adhesive resin is provided, namely an adhesive resin layer is provided, on the transparent support. Examples of this adhesive resin include a modified polyolefin-series resin, a polyester-series thermoplastic elastomer, and the like. Among these adhesive resins, a modified polyolefin-series resin is preferable, and an acid-modified polyolefin resin is more preferable. The acid-modified polyolefin resin is not particularly limited, as long as it is a polyolefin resin modified with an unsaturated carboxylic acid or its derivative. Examples of the unsaturated carboxylic acid include maleic acid, itaconic acid, and fumaric acid. Examples of their derivatives include esters and anhydrides such as maleic acid monoester, maleic acid diester, maleic anhydride, itaconic acid monoester, itaconic acid diester, itaconic anhydride, fumaric acid monoester, fumaric acid diester, and fumaric anhydride. Examples of the above-described polyolefin resin include ethylene-series copolymers such as a straight-chain polyethylene, an ultralow density polyethylene, a high density polyethylene, an ethylene-vinyl acetate (VA) copolymer, an ethylene-ethyl acrylate (EA) copolymer, and an ethylene-methacrylate copolymer, a propylene-series polymer, and a styrene-series elastomer. The acid-modified polyolefin resin may be used singly or in combination of two or more kinds thereof. Further, a polyolefin resin which is not modified by an acid may be blended therewith in such an amount that coexistence of the same is not contrary to the objectives of the present invention.

Specific examples of the acid-modified polyolefin resin include ADMER (trade name, manufactured by Mitsui Chemicals, Inc.), ADTEX (trade name, manufactured by Japan Polyethylene Corporation), POLYBOND (trade name, manufactured by Crompton Corporation) and BONDFAST (trade name, manufactured by Sumitomo Chemical Co., Ltd.).

As for the adhesive resin, the adhesive resin layer may be formed by providing an adhesive resin on one surface or both surfaces of a transparent thermoplastic resin for forming the transparent support, and subjecting them to co-extrusion. This embodiment is especially preferable in the present invention.

The average thickness of the adhesive resin layer between the transparent support and the lenticular lens resin layer is preferably 5 to 40 μm, more preferably 5 to 30 μm, and particularly preferably 6 to 30 μm.

The average thickness of the adhesive resin layer between the transparent support and the subbing layer is preferably 5 to 20 μm, more preferably 5 to 15 μm, and particularly preferably 6 to 10 μm.

[Subbing Layer]

It is particularly preferable that the subbing layer is provided on the side of the transparent support that is opposite to the side on which the lenticular lens is provided. In the present invention, it is particularly preferable that at least one resin that constitutes the subbing layer is identical with at least one resin that constitutes the lenticular lens. If the resin that constitutes the subbing layer and the resin that constitutes the lenticular lens, respectively, include multiple resins, it is preferable that all of the multiple resins are identical with each other.

Examples of the resin that constitutes the subbing layer include a polymethyl methacrylate resin (PMMA), a polycarbonate resin, a polystyrene resin, a methacrylate-styrene copolymer resin (MS resin), an acrylonitrile-styrene copolymer resin (AS resin), a polypropylene resin, a polyethylene resin, a polyethylene terephthalate resin, a glycol-modified polyethylene terephthalate resin, a polyvinyl chloride resin (PVC), a thermoplastic elastomer, copolymers thereof, a cycloolefin polymer, and the like. Upon considering the ease of melt and extrusion, it is preferable to use a resin having a low melt viscosity, for example, a polymethyl methacrylate resin (PMMA), a polycarbonate resin, a polystyrene resin, a methacrylate-styrene copolymer resin (MS resin), a polyethylene resin, a polyethylene terephthalate resin, or a glycol-modified polyethylene terephthalate resin. On the other hand, upon considering the ease of transfer, difficulty of cracking in the sheet, durability of a pattern and the like, it is more preferable to use a glycol-modified polyethylene terephthalate resin.

(Formation of Subbing Layer)

Formation of the subbing layer on the transparent support is carried out by a step, in which an embossed roller 2 shown in FIG. 1 is changed to a mirror-surface roller. A method is preferably used, in which the subbing layer is continuously formed by inserting a moving transparent support 8 between the mirror-surface roller 2 and a nip roller 3, extruding a transparent thermoplastic resin 10 from a sheet die 1 (die 1), thereby to be supplied and laminated between the transparent support 8 and the mirror-surface roller 2, and solidifying the transparent thermoplastic resin 10 by cooling while winding the resin around the mirror-surface roller 2.

Subsequently to the formation of the subbing layer, it is also preferable to provide the receptor layer described below by using a coating and drying step 7.

[Lenticular Lens]

The resin that constitutes the lenticular lens is preferably the resin that constitutes the subbing layer, and the preferable examples are the same as those of the subbing layer.

(Formation of Lenticular Lens)

A preferable method of producing a pattern of the lenticular lens includes: providing a lenticular lens forming resin layer on a sheet 8 (a substrate sheet 8) in which the subbing layer is formed on the transparent support or on a sheet 8 in which the receptor layer described below is coated after forming the subbing layer; and forming a fine pattern on the surface of this lenticular lens forming resin layer. The pattern of the lenticular lens can be preferably produced by a method of continuously transferring a pattern shape onto the surface of the moving sheet, in which the sheet 8 prior to having a lenticular lens resin layer is inserted between the embossed roller 2 having the given pattern shape and the nip roller 3, a transparent thermoplastic resin for forming the lenticular lens 10 (a resin sheet 10) and the adhesive resin are co-extruded from the sheet die 1, thereby to be supplied between the embossed roller 2 and the sheet 8 prior to having the lenticular lens resin layer, the resins are laminated by being pressed with the nip roller 3, and the laminate is solidified by cooling while being wound around the embossed roller 2. 9 represents a roll of a heat-sensitive transfer image-receiving sheet having thus laminated and formed lenticular lens.

The pattern shape of the lenticular lens resin layer of the present invention may be a conventional pattern shape and is not particularly limited. However, a preferable shape is such that the height of the lens is 60 to 80 μm, the lens pitch is 100 to 318 μm, the radius is 100 to 200 μm, and the thickness of the lens sheet is 200 to 400 μm.

Hereinafter, a preferable method of producing the lenticular lens sheet described above is explained in detail.

Herein, the term "lenticular lens sheet" means a sheet on which at least the subbing layer, the receptor layer, and the lenticular lens resin layer are formed. In addition, the lenticular lens sheet may have the adhesive resin layer. In the present invention, the lenticular lens sheet having the adhesive resin layer is a preferable embodiment. The term "patterned sheet" means a sheet, in which a concavo-convex pattern of the lenticular lens is formed.

FIG. 1 is an example of an overall process diagram showing the method of producing a patterned sheet.

As shown in FIG. 1, the method of producing the patterned sheet mainly includes: 1) a raw material step of conducting metering and mixing of raw materials; 2) an extrusion step of continuously extruding a molten resin into a sheet form (band form); 3) a transport step of conveying the sheet prior to having the lenticular lens resin layer, which is wound as roll shape; 4) a cooling and transfer step of feeding the extruded resin sheet between the embossed roller and the sheet prior to having the lenticular lens resin layer, and solidifying by cooling the sheets while laminating the sheets by pressing with the rubber roller (nip roller), thereby to transfer the pattern shape; 5) a peeling step of peeling the laminated and solidified resin sheet from the embossed roller; and 6) a rolling step of rolling up the obtained sheet into a roll form. In this manner, the lenticular lens forming resin is laminated, and the concavo-convex pattern of the lens is formed on the laminated resin.

With respect to the sheet prior to having the lenticular lens resin layer, at a first process, the subbing layer is coated on the transparent support as described above. In the process, the mirror-surface roller is used in exchange of the above-described embossed roller 2 in FIG. 1. The steps 1), 2) and 6) of the method of producing a patterned sheet are common in the process. In the process, the above-described step 3) corresponds to the transport step of conveying the transparent support wound in a roll shape. The above-described step 4) corresponds to the cooling and transfer step of feeding the extruded resin sheet between the transparent support and the mirror-surface roller and solidifying by cooling the extruded resin sheet while laminating the extruded resin sheet by pressing with the rubber roller. The above-described step 5) corresponds to the peeling step of peeling the laminated and solidified resin sheet from the mirror-surface roller. Herein, the steps 3) to 5) in the case of coating the subbing layer on the transparent support is only different from the case of coating the lenticular lens resin layer in terms of using the mirror-surface roller in exchange of the embossed roller. Namely, there is only a difference in presence or absence of the pattern on the resin and a difference in a sheet prior to coating (a transparent support or a sheet prior to having the lenticular lens resin layer) between these cases. Accordingly, a preferable embodiment of the steps 3) to 5) with respect to the embossed roller as described later is applicable.

Then, on the subbing layer of the thus-obtained sheet (the sheet in which the subbing layer is formed on the transparent support), the receptor layer is coated and dried. In this manner, the sheet prior to having the lenticular lens resin layer, which is used for the production of the patterned sheet as described above, is produced.

In the raw material step, a raw material resin sent from a raw material silo (or a raw material tank) to a vacuum dryer is dried until a predetermined moisture content is obtained.

In the extrusion step, the dried raw material resin is fed into an extruder 5 via a hopper 6, and is melted while being kneaded by this extruder 5. The extruder 5 may be a single-screw extruder or a multi-screw extruder, and may also have a vent function for evacuating the inside of the extruder 5. The raw material resin melted by the extruder 5 is sent to the die 1 (for example, a T-die) via a supply duct. At this time, plural extruders may be used to merge at a feed block and form a multilayer. In order to enhance the adhesiveness to the lenticular lens resin layer, the adhesive resin may be disposed between the lenticular lens resin layer and the transparent support. The resin sheet extruded into a sheet shape from the die 1 is then sent to the cooling and transfer step.

Herein, the sheet 8 prior to having the lenticular lens resin layer is conveyed from the transport step and enters the cooling and transfer step between the embossed roller 2 and the nip roller 3. In the cooling and transfer step, the resin sheet 10 extruded from the die is supplied between the sheet 8 prior to having the lenticular lens resin layer and the embossed roller 2, and is solidified by cooling while being laminated by pressing with the nip roller 3, and thereby the pattern shape is transferred. The solidified patterned sheet is peeled by a peeling roller 4.

On the surface of the embossed roller 2, for example, a reversal shape for molding the patterned sheet is formed. As a material of the embossed roller 2, various steel members, stainless steel, copper, zinc, brass; products produced by using these metallic materials as core metals and subjecting the materials to plating such as hard chrome plating (HCr plating), Cu plating, or Ni plating; ceramics, and various composite materials can be employed.

The nip roller 3 is a roller which is disposed opposite to the embossed roller 2 and is intended to compress the substrate sheet 8 and the resin sheet together with the embossed roller 2. Regarding the material for the nip roller 3, various steel members, stainless steel, copper, zinc, brass, and products produced by using these metallic materials as core metals and providing a rubber lining on the surface thereof, can be employed.

The nip roller 3 is provided with pressing units that are not depicted in the diagram, such that the pressing units can compress the substrate sheet 8 and the resin sheet 10 between the nip roller 3 and the embossed roller 2 with a predetermined pressure. These pressing units are all constructed to apply pressure in the normal line direction at the contact point between the nip roller 3 and the embossed roller 2, and various known units such as a motor-driven unit, an air cylinder, and a hydraulic cylinder can be employed.

For the nip roller 3, a construction, which is not likely to generate deflection due to the reaction force of the compressing force, can be employed. Examples of such construction that can be employed include a construction of providing a back-up roller which is not depicted in the diagram, on the rear side of the nip roller 3 (the side opposite to the embossed roller), a construction of employing a crown shape (a shape having a peak in the middle), a construction of using a roller having a strength distribution such that the hardness at the central part in the direction of the axis of the roller is large, and constructions combining these.

The peeling roller 4 is a roller which is disposed opposite to the embossed roller 2 and is intended to peel off the sheet on which the concavo-convex pattern of the lenticular lens has been formed, from the embossed roller 2 by winding the patterned sheet around the peeling roller. As a material of the peeling roller, for example, various steel members, stainless steel, copper, zinc, brass, and products produced by using these metallic materials as metal cores and providing a rubber lining on the surface thereof, can be employed.

The temperature of the embossed roller 2 is preferably set such that the temperature of the resin sheet at the compressed part is at or above the glass transition temperature, so that the resin sheet is not cooled and solidified before the transfer to the compressed resin sheet is completed. On the other hand, in the case where the adhesion between the embossed roller and the sheet on which the concavo-convex pattern of the lenticular lens has been formed is too strong in the peeling step using the peeling roller, the patterned sheet peels off irregularly and is deformed into a protruded shape. Therefore, it is preferable to set the temperature of the embossed roller at the lowest possible temperature to achieve transfer. In the case of employing a glycol-modified polyethylene terephthalate resin as the resin material, the surface temperature of the embossed roller can be set at 30 to 90° C., and preferably 40 to 70° C. In order to control the temperature of the embossed roller, a known method, such as filling the inside of the embossed roller with a thermal medium (warm water, oil) and circulating the thermal medium, can be employed.

The ejection temperature of the molten resin from the die 1 is preferably set such that the temperature of the resin sheet at the compressed part is at or above the glass transition temperature, so that the resin sheet is not cooled and solidified before the transfer to the compressed resin sheet is completed. On the other hand, in the case where the adhesion between the embossed roller 2 and the sheet on which the concavo-convex pattern of the lenticular lens has been formed is too strong in the peeling step using the peeling roller 4, the patterned sheet peels off irregularly and is deformed into a protruded shape. Furthermore, since there occur problems such as deterioration of the surface state due to thermal decomposition of the resin, it is preferable to set the ejection temperature at the lowest possible temperature to achieve transfer. In the case of employing the glycol-modified polyethylene terephthalate resin as the resin material, the ejection temperature from the die can be set at 240 to 290° C., and preferably at 250 to 280° C.

[Receptor Layer]

The heat-sensitive transfer image-receiving sheet used of the present invention has at least one receptor layer on the subbing layer.

The receptor layer contains a resin which plays a role of being dyed with a dye migrated from the heat-sensitive transfer sheet and maintaining a formed image. In the present invention, the receptor layer contains at least a latex polymer. It is preferable in the present invention that the heat-sensitive transfer image-receiving sheet has two or more receptor layers (preferably two receptor layers). It is a preferable embodiment that an undercoat layer is provided between the subbing layer and the receptor layer so as to impart various functions such as white background adjustment, charge prevention, adhesiveness, cushion properties, and smoothness.

(Latex Polymer)

In the present specification, the term "latex polymer" means a dispersion in which water-insoluble hydrophobic polymers are dispersed as fine particles in a water-soluble dispersion medium. The dispersed state may be one in which spherical polymer-polymerized particles and/or a polymer are emulsified in the dispersion medium, one in which the spherical polymer-polymerized particles and/or a polymer have undergone emulsion polymerization, one in which the spherical polymer-polymerized particles and/or a polymer have undergone micelle dispersion, one in which the polymer molecules partially have a hydrophilic structure and the molecular chains themselves are dispersed in a molecular state, or the like. Among them, the spherical polymer-polymerized particles are particularly preferable.

In addition to the latex polymer as a receptor polymer which receives the dye migrated from the heat-sensitive transfer sheet and thereby forms a recorded image at the time of heat-sensitive transfer, the receptor layer may also use a latex polymer having the other functions in combination for the purpose of, for example, regulating the elastic modulus of a film.

The average particle diameter of dispersed particles of the latex polymer used in the receptor layer is preferably 1 to 1,000 nm, particularly preferably 5 to 500 nm.

Examples of thermoplastic resins that are used for the latex polymer used in the receptor layer of the present invention include a polycarbonate-series polymer, a polyester-series polymer, an acrylic polymer such as polyacrylate, polyvinyl chloride, or a vinyl chloride-series copolymer (a polyvinyl chloride copolymer including a copolymer such as a vinyl chloride/vinyl acetate copolymer, a vinyl chloride/acrylic acid ester copolymer, and a vinyl chloride/methacrylic acid copolymer), a polyurethane series copolymer, a styrene-acrylonitrile copolymer, polycaprolactone, rubber (for example, SBR resin), a polyvinyl acetate copolymer including a copolymer such as a ethylene-vinyl acetate copolymer, and polyolefin.

These latex polymers may be straight-chain, branched, or cross-linked polymers, the so-called homopolymers obtained by polymerizing single type of monomers, or copolymers obtained by polymerizing two or more types of monomers. In the case of the copolymers, these copolymers may be random copolymers or block copolymers. The molecular weight of each of these polymers is preferably 5,000 to 1,000,000, and further preferably 10,000 to 500,000, in terms of number-average molecular weight.

Among them, a polyester-series polymer, a polyacrylate-series polymer, a polyvinyl chloride, and a vinyl chloride-series copolymer are preferable, a polyester-series polymer, a polyvinyl chloride, and a vinyl chloride-series copolymer are more preferable, a polyvinyl chloride and a vinyl chloride-series copolymer i.e. a polymer containing a vinyl chloride component as a polymer constituting component are further preferable, and a vinyl chloride-series copolymer is most preferable.

In the present specification, the vinyl chloride copolymer is a copolymer containing a vinyl chloride component as a polymer constituting component, and a copolymer prepared with vinyl chloride as a polymerization monomer and other monomers, and preferable examples thereof include a vinyl chloride-vinyl acetate copolymer, a vinyl chloride-acrylate copolymer, a vinyl chloride-methacrylate copolymer, a vinyl chloride/vinyl acetate/acrylate copolymer, and a vinyl chloride/acrylate/ethylene copolymer. As described above, the copolymer may be a binary copolymer or a ternary or higher copolymer, and the monomers may be distributed randomly or uniformly by block copolymerization.

In these copolymers, an auxiliary monomer component such as acrylic acid or a salt thereof, a vinyl alcohol derivative, a maleic acid derivative, or a vinyl ether derivative may be added.

It is preferable that the vinyl chloride-series copolymer used in the present invention contains vinyl chloride as a main component. The term "contain vinyl chloride as a main component" means that the vinyl chloride component is contained at a proportion of 50% by mole or more, and it is preferable that the vinyl chloride component is contained at a proportion of 50% by mole or more, while an auxiliary monomer components such as acrylic acid or a salt thereof, a maleic acid derivative, or a vinyl ether derivative is contained at a proportion of 10% by mole or less.

Examples of the vinyl chloride-series copolymer latex include VINYBLAN 240, VINYBLAN 270, VINYBLAN 276, VINYBLAN 277, VINYBLAN 375, VINYBLAN 380, VINYBLAN 386, VINYBLAN 410, VINYBLAN 430, VINYBLAN 432, VINYBLAN 550, VINYBLAN 601, VINYBLAN 602, VINYBLAN 609, VINYBLAN 619, VINYBLAN 680, VINYBLAN 680S, VINYBLAN 681N, VINYBLAN 683, VINYBLAN 685R, VINYBLAN 690, VINYBLAN 860, VINYBLAN 863, VINYBLAN 685, VINYBLAN 867, VINYBLAN 900, VINYBLAN 938 and VINYBLAN 950 (trade names, manufactured by Nissin Chemical Industry Co., Ltd.); and SE1320, S-830 (trade names, manufactured by Sumika Chemtex Company, Limited). In the present invention, these are preferable latex polymers.

The latex polymer other than the vinyl chloride-series latex copolymer may include a polyester-series latex polymer. The polyester-series latex polymer is exemplified by Vylonal MD 1200, Vylonal MD 1220, Vylonal MD1245, Vylonal MD1250, Vylonal MD1500, Vylonal MD1930, and Vylonal MD1985 (trade names, manufactured by Toyobo Co., Ltd.).

Hereinafter, particularly preferable vinyl chloride-series latex polymers are described. Vinyl chloride-series latex copolymers such as a vinyl chloride/acrylic compound latex copolymer (particularly, a vinyl chloride/acrylic ester latex copolymer), a vinyl chloride/vinyl acetate latex copolymer, a vinyl chloride/vinyl acetate/acrylic compound latex copolymer (particularly, a vinyl chloride/vinyl acetate/acrylic ester latex copolymer), are preferable, a vinyl chloride/acrylic compound latex copolymer is most preferable.

In the present invention, it is also preferable to use the latex polymers in combination of two or more kinds thereof. These latex polymers are more preferably polyvinyl chloride or a vinyl chloride-series copolymer. At least one kind of these latex polymers is preferably a vinyl chloride-series copolymer (particularly, a vinyl chloride/acrylic acid ester). In the case of combining two kinds of the latex polymers, both kinds of the latex polymers are more preferably a vinyl chloride-series copolymer.

In the case where the heat-sensitive transfer image-receiving sheet has two receptor layers, it is preferable that all of these receptor layers contain the respective latex polymers of vinyl chloride and a vinyl chloride-series copolymer, and it is also preferable that a resin contained in the upper receptor layer have a higher glass transition temperature (Tg) than that of a resin contained in the lower receptor layer (receptor layer attached to the support).

In the present invention, the latex polymer used in the receptor layer may be used singly or as a mixture of two or more kinds thereof. The latex polymer used in the receptor layer may have a uniform structure or a core/shell structure, and in the latter case, the resins constituting the core and the shell, respectively, may have different glass transition temperatures. Further, it is preferable to use at least two kinds of the latex polymers, since the weighted glass transition temperature (Tg) can be arbitrarily controlled. In this case, it is preferable that said at least two kind of the latex polymers are polyvinyl chloride or a vinyl chloride/acrylic copolymer as mentioned above.

In the present invention, the weighted average glass transition temperature (Tg) of the latex polymer used in the receptor layer is 30° C. or more, preferably 30° C. to 120° C., and further preferably 40° C. to 100° C.

The glass transition temperature (Tg) of the latex polymer used in the receptor layer of the present invention is preferably −30° C. to 100° C., more preferably 0° C. to 90° C., furthermore preferably 20° C. to 90° C., and particularly preferably 40° C. to 90° C.

The glass transition temperature (Tg), if not practically measurable, may be calculated according to the following formula:

$$1/Tg=\Sigma(Xi/Tgi)$$

wherein, assuming that the polymer is a homopolymer or copolymer composed of n monomers from i=1 to i=n; Xi is a mass fraction of the i-th monomer (ΣXi=1); Tgi is a glass transition temperature (measured in absolute temperature) of a homopolymer formed from the i-th monomer; and the symbol Σ means the sum of i=1 to i=n. The value of the glass transition temperature of a homopolymer formed from each monomer (Tgi) can be adopted from J. Brandrup and E. H. Immergut, "Polymer Handbook, 3rd. Edition", Wiley-Interscience (1989).

The latex polymer preferably used in the present invention is such that the polymer concentration is preferably 10 to 70% by mass, and more preferably 20 to 60% by mass, based on the latex liquid. The total addition amount of the latex polymer in the receptor layer is such that the solid content of the latex polymer is preferably 50 to 98% by mass, and more preferably 70 to 95% by mass, based on the total amount of the polymer in the receptor layer.

(Water-Soluble Polymer)

In the present invention, the receptor layer may contain a water-soluble polymer. A gelatin, a polyvinyl alcohol, a polyvinylpyrrolidone, a polyvinylpyrrolidone copolymer, and the like are preferably used. The amount of these water-soluble polymers to be used is preferable from 0 to 10% by mass, with respect to the total mass of the solid content of the receptor layer, in order to eliminate the negative effects of reduction in transfer density. Particularly in the present invention, it is most preferable from the viewpoint of achieving the effects of the present invention that neither gelatin nor polyvinyl alcohol is contained in the receptor layer.

(Polyether-Modified Silicone)

In the present invention, it is preferable that the receptor layer contains silicone, and it is more preferable that the receptor layer contains a polyether-modified silicone. As the polyether-modified silicone, it is particularly preferable that the receptor layer contains a polyether-modified silicone represented by the following formula (S1).

Formula (S1)

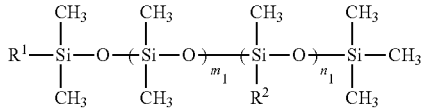

In formula (S1), $R^1$ represents an alkyl group; $R^2$ represents —X—$(C_2H_4O)_{a1}$—$(C_3H_6O)_{b1}$—$R^3$; $R^3$ represents a hydrogen atom, an acyl group, a monovalent alkyl group, a monovalent cycloalkyl group, or a monovalent aryl group; X represents an alkylene group or an alkyleneoxy group; $m_1$ and $n_1$ each independently represent a positive integer; $a_1$ represents a positive integer; and $b_1$ represents 0 or a positive integer.

The alkyl group represented by $R^1$ may represent a branched alkyl group. The alkyl group represented by $R^1$ is preferably an alkyl group having 1 to 20 carbon atoms, more preferably 1 to 8 carbon atoms, still more preferably 1 to 4 carbon atoms. Among them, a methyl group and an ethyl group are preferable and a methyl group is most preferable.

The acyl group having an acyl moiety represented by $R^3$ includes, for example, an acetyl group, a propionyl group, a buthylyl group, and a benzoyl group. Among these acyl groups, an acyl group having 2 to 20 carbon atoms is preferable and an acyl group having 2 to 10 carbon atoms is more preferable.

The monovalent alkyl group represented by $R^3$ includes, for example, a methyl group, an ethyl group, a propyl group, an isopropyl group, a buthyl group, and a tert-buthyl group. The monovalent alkyl group is preferably a monovalent alkyl group having 1 to 20 carbon atoms, more preferably 1 to 10 carbon atoms.

The monovalent cycloalkyl group represented by $R^3$ includes, for example, a cyclopenthyl group and a cyclohexyl group. The monovalent cycloalkyl group is preferably a monovalent cycloalkyl group having 5 to 10 carbon atoms.

The monovalent aryl group represented by $R^3$ includes, for example, a phenyl group and a naphthyl group. An aryl moiety of the monovalent aryl group is preferably a benzene ring.

$R^3$ preferably represents a monovalent alkyl group, preferably a methyl group and a butyl group, particularly preferably a methyl group.

The linking group represented by X is preferably an alkylene group and an alkyleneoxy group. The alkylene group preferably includes, for example, a methylene group, an ethylene group, and a propylene group. The alkyleneoxy group preferably includes, for example, —$CH_2CH_2O$—, —$CH(CH_3)CH_2O$—, —$CH_2CH(CH_3)O$—, and —$(CH_2)_3O$—. The linking group represented by X preferably has 1 to 4 carbon atoms and more preferably 2 or 3.

In addition, X more preferably represents an alkyleneoxy group and particularly preferably a propyleneoxy group (—$(CH_2)_3O$—).

$a_1$ is preferably an integer of 1 or larger, more preferably 1 to 200, and furthermore preferably 1 to 100. $b_1$ is preferably 0 or an integer of 1 or larger, more preferably 0 to 200, and furthermore preferably 0 to 100. Further, in order to more effectively exhibit the action of preventing separation lines in high-density image areas, by the present invention, it is more preferable that among the values of $a_1$ and $b_1$, $a_1$ is preferably 30 or larger, more preferably 35 or larger, particularly preferably 40 or larger. Herein, the preferably upper limit of $a_1$ is 100 or less. Both of $a_1$ and $b_1$ are 30 or larger, more preferably 35 or larger, particularly preferably 40 or larger. Herein, the preferably upper limit of each of $a_1$ and $b_1$ is 100 or less.

In order to more effectively exhibit the effects of the present invention, $m_1$ is preferably 10 to 500, more preferably 30 to 300, and most preferably 50 to 200.

$n_1$ is preferably 1 to 50, and more preferably 1 to 20.

The polyether-modified silicone preferably has an average molecular weight of 55,000 or less, and more preferably 40,000 or less. The term "average molecular weight" in the present invention means a mass average molecular weight. The mass average molecular weight used herein is a molecular weight obtained by measuring a molecular weight with a GPC analyzer using columns of TSKgel GMHxL, TSKgel G4000HxL and TSKgel G2000HxL (trade names, manufactured by Tosoh Corporation) and then converting the measured value using polystyrene as a reference material; the solvent used for GPC is THF and the detection is conducted by a differential refractometer.

It is preferable that the polyether-modified silicone is a liquid at 25° C.

The viscosity of the polyether-modified silicone is preferably from 500 mPa·s to 10,000 mPa·s, more preferably from 1,000 mPa·s to 5,000 mPa·s, and furthermore preferably from 2,000 mPa·s to 5,000 mPa·s. The methods of measuring the viscosity may be roughly classified into a method of measuring a resistance force exerted to a rotating body in a liquid and a method of measuring a pressure loss occurring when the liquid is passed through an orifice or a capillary. The former method involves a rotary type viscometer, which is represented by a B type viscometer. The latter method involves a capillary viscometer, which is represented by an Ostwald viscometer. In the present invention, the viscosity is defined as a value measured with the B type viscometer at a temperature of 25° C.

The HLB (Hydrophile-Lipophile-Balance) value of the polyether-modified silicone represented by formula (S1) is preferably 4.0 to 8.0, and particularly preferably 4.5 to 6.5. If the HLB value is too low, failure in the surface state is likely to occur. If the HLB value is too high, the ability of preventing the generation of separation lines is decreased.

In the present invention, the HLB value is determined by a calculation formula defined by the following expression, according to the Griffin's method ("Kaimennkasseizaibinnrann (Handbook of Surfactant)," co-authored by Ichiro Nishi, Tooziro Imai and Masai Kasai, published by Sangyo Tosho Co., Ltd., 1960).

$$HLB=20\times Mw/M$$

Herein, M represents a molecular weight, and Mw represents a formula weight (molecular weight) of a hydrophilic moiety. In addition, M=Mw+Mo, in which Mo is a formula weight (molecular weight) of a lipophilic moiety. The hydrophilic moiety in this case is an alkyleneoxy group.

Specific examples of the polyether-modified silicone oil preferably used in the present invention include KF-351A, KF-352A, KF-353, KF-354L, KF-355A, KF-615A, KF-945, KF-640, KF-642, KF-643, KF-6020, KF-6011, KF-6012, KF-6015, KF-6017, X-22-4515, and X-22-6191, manufactured by Shin-Etsu Chemical Co., Ltd.; SH3749, SH3773M, SH8400, SF8427, SF8428, FZ-2101, FZ-2104, FZ-2110, FZ-2118, FZ-2162, FZ-2203, FZ-2207, FZ-2208, FZ-77, L-7001, and L-7002, manufactured by Dow Corning Toray Co., Ltd. (all trade names).

The polyether-modified silicone oil preferably used in the present invention can be easily synthesized by the methods described in, for example, JP-A-2002-179797, JP-A-2008-1896, and JP-A-2008-1897, or methods equivalent to these methods.

In the present invention, the polyether-modified silicone oil can be used singly, or in combination of two or more kinds thereof. Also, in the present invention, a releasing agent may be used, in addition to the polyether-modified silicone oil.

The addition amount of the polyether-modified silicone oil is preferably 1% by mass to 20% by mass (solid content %), and more preferably 1% by mass to 10% by mass (solid content %), to the total amount of the latex polymer in the receptor layer.

The coating amount of the receptor layer of the present invention is preferably 0.5 to 10.0 g/m$^2$, and more preferably 1.0 to 8.0 g/m$^2$. The term "coating amount" in the present specification is a value calculated in terms of the solid content, unless particularly stated otherwise.

(Surfactant)

In the present invention, it is preferable that the receptor layer contains a surfactant. The surfactant is preferably an anionic surfactant or a nonionic surfactant, and is more preferably an anionic surfactant.

Among the anionic surfactants, it is more preferable that the receptor layer contains at least one anionic surfactant represented by the following formula (A1) or (A2). In order to greatly exhibit the effects of the present invention, the anionic surfactant is particularly preferably a compound represented by the following formula (A1).

Formula (A1)

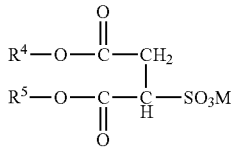

In formula (A1), $R^4$ and $R^5$ each independently represent an alkyl group having 3 to 20 carbon atoms, preferably an alkyl group having 4 to 10 carbon atoms, and more preferably a branched alkyl group having 4 to 10 carbon atoms. $R^4$ and $R^5$ each particularly preferably are a 2-ethylhexyl group.

In formula (A1), M represents a hydrogen atom or a cation. Preferable examples of the cation represented by M include an alkali metal ion (e.g., a lithium ion, a sodium ion, a potassium ion), an alkaline-earth metal ion (e.g., a barium ion, a calcium ion), and an ammonium ion. Among these, a lithium ion, a sodium ion, a potassium ion and an ammonium ion are more preferable; and a lithium ion, a sodium ion and a potassium ion are particularly preferable.

Formula (A2)

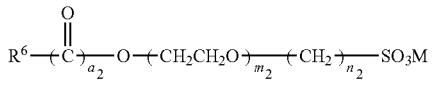

In formula (A2), $R^6$ represents an alkyl group or an alkenyl group, each having 6 to 20 carbon atoms; preferably an alkyl group or an alkenyl group, each having 10 to 20 carbon atoms; and most preferably an alkyl group or an alkenyl group, each having 14 to 20 carbon atoms.

$R^6$ may represent a branched, alkyl or alkenyl group.

In formula (A2), M represents a hydrogen atom or a cation. Preferable examples of the cation represented by M include an alkali metal ion (e.g., a lithium ion, a sodium ion, a potassium ion), an alkaline-earth metal ion (e.g., a barium ion, a calcium ion), and an ammonium ion. Among these, a lithium ion, a sodium ion, a potassium ion and an ammonium ion are more preferable; and a lithium ion, a sodium ion and a potassium ion are particularly preferable.

$m_2$ represents an average number of added moles, and is preferably larger than 0 and equal to or less than 10. $m_2$ is more preferably 1 to 6, and most preferably 2 to 4.

$n_2$ represents an integer from 0 to 4, and is particularly preferably 2 to 4.

$a_2$ represents 0 or 1, and is particularly preferably 0.

Specific examples of the compound are described below. However, the anionic surfactant used in the present invention is not limited thereto.

A1-1

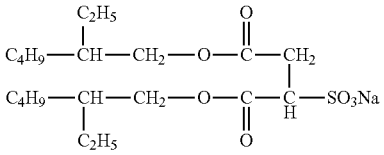

A1-2

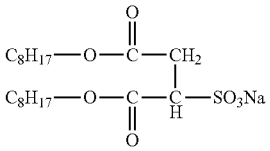

A1-3

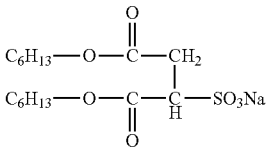

A1-4

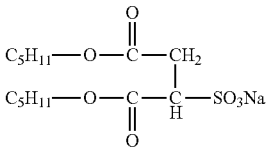

A1-5

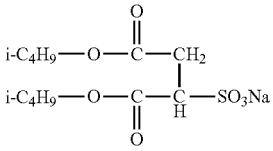

A1-6

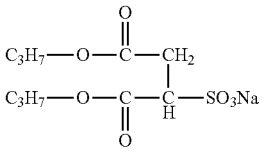

A1-7

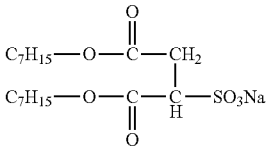

-continued

A1-8

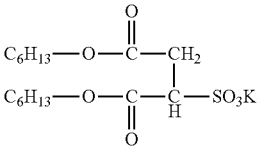

A1-9

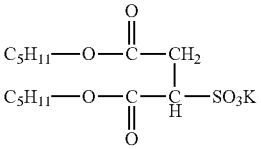

A1-10

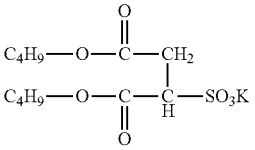

A2-1

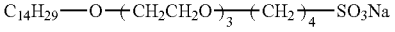

A2-2

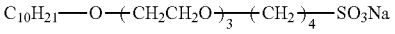

A2-3

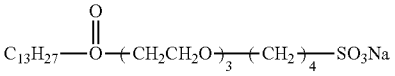

A2-4

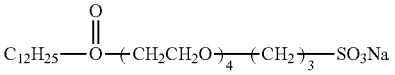

A2-5

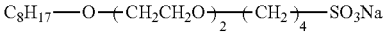

A2-6

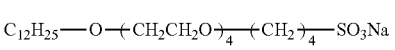

A2-7

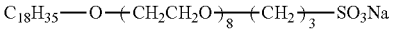

The anionic surfactant represented by formula (A1) and the anionic surfactant represented by (A2) not only contribute to stabilization of the surface state by imparting wettability to a coating liquid, but also suppresses the generation of separation lines in the high-density image areas by using in combination with the polyether-modified silicone represented by formula (S1). The anionic surfactant also has an effect of preventing gloss unevenness.

The anionic surfactant represented by formulae (A1) and the anionic surfactant represented by (A2) may be incorporated into any layer such as a heat insulation layer or an intermediate layer, in addition to the receptor layer.

The total coating amount of the anionic surfactant represented by formula (A1) and the anionic surfactant represented by (A2) is preferably from 5 mg/m$^2$ to 500 mg/m$^2$, and more preferably from 10 mg/m$^2$ to 200 mg/m$^2$.

Furthermore, in the present invention, in addition to the anionic surfactant represented by formula (A1) and the anionic surfactant represented by formula (A2), other various surfactants such as anionic, nonionic and cationic surfactants may also be used in combination in the receptor layer.

An example of the other surfactants preferably used in combination with the anionic surfactant represented by formula (A1) and the anionic surfactant represented by (A2) is a fluorine-containing compound represented by the following formula (H).

Formula (H)

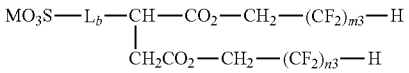

In formula (H), $m_3$ and $n_3$ each independently represents an integer of 2 to 8, preferably 2 to 6, more preferably 3 to 6. The total value of $m_3$ and $n_3$ is preferably 6 to 12, more preferably 6 to 10. Among them, m3 and n3 are preferably the same from each other, and most preferably m3 and n3 each are 4.

Preferable examples of the cation represented by M include an alkali metal ion (e.g., a lithium ion, a sodium ion, a potassium ion), an alkaline-earth metal ion (e.g., a barium ion, a calcium ion), and an ammonium ion. Among these, a lithium ion, a sodium ion, a potassium ion and an ammonium ion are more preferable; and a lithium ion, a sodium ion and a potassium ion are particularly preferable.

$L_b$ represents an alkylene group, which is a single bond. In the case where $L_b$ represents an alkylene group, the alkylene group is preferably an alkylene group having 2 or less carbon atoms, more preferably a methylene group. It is the most preferable that $L_b$ is a single bond.

It is preferable to combine the above preferable embodiments from each other in formula (H).

The specific examples of the compound represented by formula (H) are described below. However, the compound represented by formula (H) that can be used in the present invention is not limited thereto. In the following descriptions on the structure of the example compounds, unless particularly stated otherwise, the alkyl group and perfluoroalkyl group mean groups having a linear structure.

(H)-1

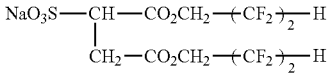

(H)-2

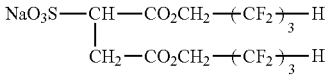

(H)-3

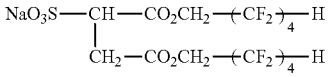

(H)-4

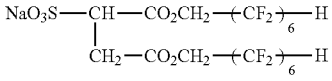

(H)-5

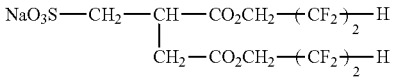

(H)-6

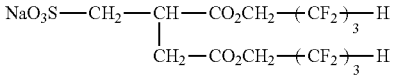

(H)-7

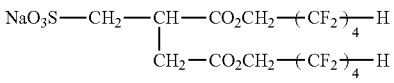

-continued (H)-8

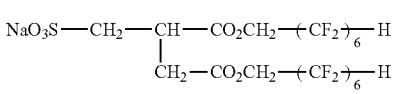

(H)-9

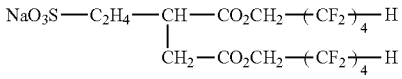

(H)-10

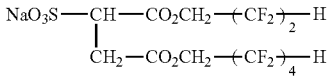

(H)-11

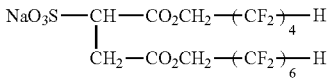

The coating amount of the fluorine-containing compound represented by formula (H) is preferably from 0.5 mg/m$^2$ to 50 mg/m$^2$ and more preferably from 1 mg/m$^2$ to 20 mg/m$^2$ in the layer to which the compound is added.

(Other Additive)

The receptor layer of the present invention may contain an additive, according to the necessity. Examples of the additive include an ultraviolet absorbent, an antiseptic agent, a film-forming aid, a film-hardening agent, a matting agent (including a lubricating agent), an antioxidizing agent, and other additives.

(Ultraviolet Absorbent)

The heat-sensitive transfer image-receiving sheet of the present invention may contain an ultraviolet absorbent. As the ultraviolet absorbents, typical inorganic or organic ultraviolet absorbents are used. As the organic ultraviolet absorbents, non-reactive ultraviolet absorbents such as salicylate-series, benzophenone-series, benzotriazole-series, triazine-series, substituted acrylonitrile-series, and hindered amine-series ultraviolet absorbents; copolymers or graft polymers of thermoplastic resins (e.g., acrylic resins) obtained by introducing, for example, an addition-polymerizable double bond (e.g., a vinyl group, an acryloyl group, a methacryloyl group), or an alcoholic hydroxyl group, an amino group, a carboxyl group, an epoxy group, or an isocyanate group, to the non-reactive ultraviolet absorbents, subsequently copolymerizing or grafting can be used. In addition, a method is disclosed, in which ultraviolet absorbents are dissolved in a monomer or oligomer of the resin and then the monomer or oligomer is polymerized (JP-A-2006-21333), and the ultraviolet-shielding resins obtained by this method can be used. In this case, the ultraviolet absorbents may be non-reactive.

Among these ultraviolet absorbents, benzophenone-series, benzotriazole-series, and triazine-series ultraviolet absorbents are particularly preferable. It is preferable that these ultraviolet absorbents are used in combination thereof, so as to cover an effective ultraviolet absorption wavelength region, according to the property of a dye used in an image formation. In addition, in the case of the non-reactive ultraviolet absorbents, it is preferable to use a mixture of two or more kinds of ultraviolet absorbents each having a different structure from each other, so as to prevent the ultraviolet absorbents from precipitating.

Examples of commercially available ultraviolet absorbents include TINUVIN-P (trade name, manufactured by Ciba-Geigy), JF-77 (trade name, manufactured by JOHOKU CHEMICAL Co., Ltd.), SEESORB 701 (trade name, manufactured by SHIRAISHI CALCIUM KAISHA, Ltd.), SUMISORB 200 (trade name, manufactured by Sumitomo Chemical Co., Ltd.), VIOSORB 520 (trade name, manufactured by KYODO CHEMICAL Co., Ltd.), and ADKSTAB LA-32 (trade name, manufactured by ADEKA).

(Antiseptic)

To the heat-sensitive transfer image-receiving sheet of the present invention, an antiseptic may be added. The antiseptic that may be contained in the image-receiving sheet of the present invention is not particularly limited. For example, materials, described in Bofubokabi (Preservation and Antifungi) HAND BOOK, Gihodo shuppan (1986), Bokin Bokabi no Kagaku (Chemistry of Anti-bacteria and Antifungi) authored by Hiroshi Horiguchi, Sankyo Shuppan (1986), Bokin Bokabizai Jiten (Encyclopedia of Antibacterial and Antifungal Agent) edited by The Society for Antibacterial and Antifungal Agent, Japan (1986), can be used. Specific examples thereof include an imidazole derivative, sodium dehydroacetate, a 4-isothiazoline-3-on derivative, benzoisothiazoline-3-on, a benzotriazole derivative, an amidineguanidine derivative, a quaternary ammonium salt, pyrrolidine, quinoline, a guanidine derivative, diazine, a triazole derivative, oxazole, an oxazine derivative, and 2-mercaptopyridine-N-oxide or its salt. Among them, a 4-isothiazoline-3-on derivative and benzoisothiazoline-3-on are preferable.

(Film-Forming Aid)

It is preferable to add a high boiling point solvent to the heat-sensitive transfer image-receiving sheet of the present invention. The high boiling point solvent is an organic compound (typically, an organic solvent) which functions as a film-forming aid or a plasticizer, and lowers the lowest film-forming temperature of the latex polymer, and such solvents are described in, for example, "Gosei Latex no Kagaku (Chemistry of Synthetic Latex)", Soichi Muroi, issued by Kobunshi Kanko Kai (1970). Examples of the high boiling point solvent (film-forming aid) include the following compounds.

Z-1: Benzyl alcohols

Z-2: 2,2,4-Trimethylpentanediol-1,3-monoisobutyrates

Z-3: 2-Dimethylaminoethanols

Z-4: Diethylene glycols

When these high boiling point solvents are added to the image-receiving sheet, loss of definition of image is observed, and there is an undesirable case for practical use. However, if the solid content of the solvents in the coating film is not too large, there is no problem in terms of performance.

(Hardening Agent)

The heat-sensitive transfer image-receiving sheet of the present invention may contain a hardening agent (hardener). The hardening agent may be added to a coated layer(s) of the heat-sensitive transfer image-receiving sheet.

Preferable examples of the hardener that can be used in the present invention include H-1, 4, 6, 8 and 14 on page 17 of JP-A-1-214845; compounds (H-1 to H-54), respectively, represented by any one of formulae (VII) to (XII) in columns 13 to 23 of U.S. Pat. No. 4,618,573; compounds (H-1 to H-76), respectively, represented by formula (6) in the lower right on page 8 of JP-A-2-214852, (particularly, H-14); and compounds described in claim 1 of U.S. Pat. No. 3,325,287. Examples of the hardening agent include hardening agents described, for example, in column 41 of U.S. Pat. No. 4,678,739, U.S. Pat. No. 4,791,042, JP-A-59-116655, JP-A-62-245261, JP-A-61-18942, and JP-A-4-218044. More specifically, an aldehyde-series hardening agent (e.g. formaldehyde), an aziridine-series hardening agent, an epoxy-series hardening agent, a vinyl sulfone-series hardening agent (e.g. N,N'-ethylene-bis(vinylsulfonylacetamido) ethane), an N-methylol-series hardening agent (e.g. dimethylol urea), a boric acid, a metaboric acid, or a polymer hardening agent (compounds described, for example, in JP-A-62-234157), can be exemplified. Preferable examples of the hardener include a vinyl sulfone-series hardener and chlorotriazines.

(Matting Agent)

In the heat-sensitive transfer image-receiving sheet of the present invention, a matting agent may be added, in order to prevent blocking, or to give a release property or a sliding property. The matting agent may be added to the side of the image-receiving sheet, to which the receptor layer is coated. In detail, the matting agent may be added to the receptor layer, a white layer, a heat transferable protective layer, and the like.

Examples of the matting agent generally include fine particles of water-insoluble organic compounds and fine particles of water-insoluble inorganic compounds. In the present invention, the organic compound-containing fine particles are preferably used from the viewpoints of dispersion property. In so far as the organic compound is incorporated in the particles, there may be organic compound particles consisting of the organic compound singly, or alternatively organic/inorganic composite particles containing not only the organic compound but also an inorganic compound. As the matting agent, there can be used organic matting agents described in, for example, U.S. Pat. Nos. 1,939,213, 2,701,245, 2,322,037, 3,262,782, 3,539,344, and 3,767,448.

[Method of Producing Receptor Layer]

Hereinafter, the method of producing the receptor layer of the present invention is explained.

The receptor layer of the present invention is preferably an aqueous type coating layer. Herein, the term "aqueous type" means that 60% by mass or more of a solvent (dispersion medium) of a coating liquid is water. As a component other than water in the coating liquid, an organic solvent miscible with water may be used. Examples thereof include methyl alcohol, ethyl alcohol, isopropyl alcohol, methyl cellosolve, ethyl cellosolve, dimethylformamide, diacetone alcohol, furfuryl alcohol, benzyl alcohol, diethylene glycol monoethyl ether, and oxyethyl phenyl ether. In the case of adding an emulsified dispersion to the receptor layer, ethyl acetate may be also used as a part of the organic solvent miscible with water.

In the case of coating two or more receptor layers and other functional layers on the subbing layer of the transparent support, it has been known to produce the layers by sequentially coating each of the layers over and over, or by coating each of the layers in advance on the support and adhering the assemblies, as disclosed in JPA-2004-106283, JP-A-2004-181888, JP-A-2004-345267, and the like. On the other hand, it has been known, in photographic industries, that productivity can be greatly improved, for example, by providing plural layers through simultaneous multi-layer coating. For example, there are known methods, such as the so-called slide coating (slide coating method) and curtain coating (curtain coating method), as described in, for example, U.S. Pat. Nos. 2,761,791, 2,681,234, 3,508,947, 4,457,256 and 3,993,019; JP-A-63-54975, JP-A-61-278848, JP-A-55-86557, JP-A-52-31727, JP-A-55-142565, JP-A-50-43140, JP-A-63-80872, JP-A-54-54020, JP-A-5-104061, JP-A-5-127305, and JP-B-49-7050 ("JP-B" means examined Japanese patent application); and Edgar B. Gutoff, et al., "Coating and Drying Defects: Troubleshooting Operating Problems", John Wiley & Sons, 1995, pp. 101-103. According to these coating methods, two or more kinds of coating liquids are fed simultaneously into a coating apparatus and formed into two or more different layers.

The method of producing the receptor layer of the present invention is preferably carried out by the slide coating or the curtain coating. Even in the case of coating plural layers, coating of these layers can be carried out by the simultaneous multilayer-coating and high productivity can be realized, by these coating methods.

Herein, in the case of conducting the simultaneous multilayer-coating, it is necessary to adjust the viscosity and surface tension of the coating liquid, from the viewpoint of forming a uniform coating film and obtaining a satisfactory coatability. The viscosity of the coating liquid can be easily adjusted using usual thickeners or viscosity reducers in such a degree that they do not affect to other performances. Further, the surface tension of the coating liquid can be adjusted using various kinds of surfactants.

The temperature of these coating liquids for coating various layers is preferably 25° C. to 60° C., and more preferably 30° C. to 50° C. Particularly, the temperature of the coating liquids in the case of using gelatin in the coating liquid is preferably 33° C. to 45° C.

In the present invention, the coating amount of the coating liquid for a layer is preferably in the range of 1 g/m$^2$ to 500 g/m$^2$. The number of layers in the multilayer constitution can be arbitrarily selected to be two or more. It is preferable that the receptor layer is provided as a layer disposed farthest from the support.

In a setting zone and a drying zone, moisture migration occurs between the respective coated films (coated layers) and between the support and the coated films, and solidification also occurs due to cooling of the coated films and moisture evaporation. For these reasons, the quality and performance of the resultant product are greatly influenced by the processing history, such as the layer surface temperature during drying and the drying period of time, and it is required to set the conditions in accordance with the demanded quality.

The temperature of the setting zone is 15° C. or less, and it is preferable to set the time period of a cooling step in the setting zone within a range from 5 seconds or more to less than 30 seconds. If the time period of the cooling step is too short, a sufficient increase of the coating liquid viscosity cannot be obtained, and the surface state is deteriorated upon the subsequent drying step. On the other hand, if the time period of the cooling step is too long, the removal of moisture in the subsequent drying step takes a long time, and the production efficiency is decreased.

In the dry zone in the producing method of the present invention, the drying step is necessary to be conducted, at a temperature of at least 30° C. higher than the weighted average glass transition temperature (Tg) of the latex polymers contained in the receptor layer (preferably at a temperature from 30° C. to less than 80° C. higher than the weighted average glass transition temperature (Tg)). It is preferable that the drying step is conducted at a higher temperature, in order to obtain an effect in a short time. It is more preferable that the drying step is conducted at a temperature from 40° C. to less than 80° C. above the weighted average glass transition temperature (Tg).

Herein, the weighted average glass transition temperature (Tg) is obtained as follows. In the case where two or more kinds of the latex polymers are contained in the receptor layer, the total of the solid content mass of each of the latex polymers (the total solid content mass) is measured. Further, the glass transition temperature (Tg) of each of the latex polymers is multiplied by the ratio of the solid content mass, and then the sum of the thus-obtained values is calculated to obtain the weighted average glass transition temperature (Tg).

For example, in the case where 20 g of latex polymer A having 70° C. of a glass transition temperature with 40% of a solid content and 20 g of latex polymer B having 46° C. of a glass transition temperature with 55% of a solid content are mixed for use, the weighted average glass transition temperature is 56° C., which is derived from the following calculation:

$$70^\circ\text{ C.}\times(20\times0.4/(20\times0.4+20\times0.55)+46^\circ\text{ C.}\times(20\times0.55/(20\times0.4+20\times0.55))=56^\circ\text{ C.}$$

Further, even in the case where the latex polymer is phase-separated or has the core/shell structure, the weighted average glass transition temperature (Tg) can be obtained in the same manner as the above.

The highest temperature at the drying step is preferably from 60° C. to less than 180° C., and more preferably from 60° C. to less than 150° C. If the temperature is too high, deteriorations of properties such as shrinkage of the sheet may be caused.

It is particularly preferable to carry out the drying step by passing through both a constant-rate drying period in which a drying rate is constant and a material temperature and a wet-bulb temperature are almost equal to each other, and a decreasing drying period in which a drying rate becomes slow and the material temperature increases. In the present invention, it is preferable to conduct drying at a temperature of at least 30° C. higher than the weighted average glass transition temperature (Tg) of the latex polymer contained in the receptor layer after the end of the constant-rate drying period. Further, it is most preferable to conduct drying during initial stage of the drying step under the condition of a low temperature outside the drying temperature of the present invention (the low temperature refers to a temperature of less than 30° C., preferably from 5° C. to less than 30° C., more preferably from 10° C. to less than 30° C., and furthermore preferably from 10° C. to 25° C., respectively, below the weighted average glass transition temperature (Tg) of the latex polymer), and to conduct drying during late stage of the drying step under the condition of a high temperature of the present invention. Though the drying temperature during initial stage of the drying step depends on the weighted average glass transition temperature (Tg) of the latex polymer contained in the receptor layer, it is preferably from 30 to 90° C., more preferably from 35 to 85° C., and furthermore preferably from 40 to 80° C. Further, in the drying step, the drying after coating the receptor layer is preferably carried out at least two drying zones, and more preferably at least three drying zones. In this case, the drying temperature is equal to each other between a first drying zone and a second drying zone. Further, the case where a drying time is equal to each other in these drying zones is more preferable. Further, the speed of wind in each drying zone is preferably from 0.5 m/second to 10 m/second, and more preferably from 1 m/second to 8 m/second.

The time of drying at a temperature of at least 30° C. higher than the weighted average glass transition temperature (Tg) of the latex polymer contained in the receptor layer is preferably from 3 seconds to less than 300 seconds, more preferably from 3 seconds to less than 120 seconds, and furthermore preferably from 5 seconds to less than 60 seconds. To carry out the constant-rate drying for too long time period results in deterioration of properties such as shrinkage of the sheet, as well as reduction in productivity, and accordingly is not preferable. On the other hand, to carry out the constant-rate drying for too short time period makes it difficult to achieve the effects of the present invention.

The coat-finished product which has been dried is adjusted to have a certain water content, followed by winding up. Since the progress of film hardening is affected by the water content and temperature during the storage of the wound, coat-finished product, it is necessary to set the conditions for humidification step that are appropriate for the water content in the wound-up state.

In general, a film-hardening reaction can be carried out more easily at high temperature and high humidity conditions. However, if the water content is too high, adhesion between the coated products may occur, or there may be a problem in terms of performance. For this reason, it is necessary to set the water content in the wound-up state (humidification conditions) and the storage condition in accordance with the product quality.

Typical drying devices include an air-loop system, a helical system, and the like. The air-loop system, is a system in which drying blasts are made to blow on the coat-finished product supported by a roller and a duct may be mounted either longitudinally or transversely. Such a system has a high degree of freedom in setting of the volume of drying wind or the like, since a drying function and a transporting function are basically separated therein. However, many rollers are used therein, so base-transporting failures, such as gathering, wrinkling, and slipping, tend to occur. The helical system is a system, in which the coat-finished product is wound round a cylindrical duct in a helical fashion, and is transported and dried while it is floated by drying wind (air floating). So no support by rollers is basically required (JP-B-43-20438). In addition to those, there is a drying system, in which the coated-finished product is conveyed by reciprocally installing upper and lower ducts. In general, this system has a better dryness distribution than that of the helical system, but is poor in floatability.

<Heat-Sensitive Transfer Sheet>

In the heat-sensitive transfer image-receiving sheet of the present invention, the dye is transferred by the heat-sensitive transfer sheet to form an image, and then a white layer (white transfer layer) is transferred. The heat-sensitive transfer sheet for transferring the dye and the heat-sensitive transfer sheet for transferring the white layer may be an integrated sheet or separate sheets. The heat transferable protective layer may be transferred after the white layer is transferred.

The integrated heat-sensitive transfer sheet is a sheet obtained by providing (forming), in area order, on a support such as polyethylene terephthalate (PET), dye layers (colorant layers) prepared by dispersing dyes of three colors, such as yellow, magenta, and cyan, respectively, in a binder resin, and a white layer. In the case of the separate sheets, for the sheet for dye transfer, use is made of a sheet obtained by providing, in area order, on the support described above, dye layers prepared by dispersing dyes of three colors, such as yellow, magenta, and cyan, respectively, in the binder resin, while for the sheet for the white layer transfer, a sheet obtained by providing the white layer on the support described above is used.

The term "forming layers in area order" as used in the present specification means forming dye layers each having a different hue and/or function layers in the longitudinal direction on the support of the heat-sensitive transfer sheet, by applying them separately in order.

Examples include the case in which a yellow dye layer, a magenta dye layer, and a cyan dye layer are formed in this order in the longitudinal direction on the support.

Further, any arrangement of these dye layers can be employed, but it is preferred that a yellow dye layer, a magenta dye layer, and a cyan dye layer be arranged sequentially in this order on the support.

Herein, with respect to the dye transfer, an embodiment, in which the dye layers are constituted of four colors, including black in addition to the three colors, is also acceptable.

In the case of transferring the heat transferable protective layer, in the integrated heat-sensitive transfer sheet, the heat-transferable protective layer may be provided after providing the white layer. In the case of the separate sheets, the heat transferable protective layer may be provided, in area order, on the heat sensitive transfer sheet provided with the white layer, or a sheet having the heat transferable protective layer provided on another sheet may be used.

Further, in the integrated heat-sensitive transfer sheet, the heat-transferable protective layer may be provided before providing the white layer. In the case of the separate sheets, a heat-sensitive transfer sheet obtained by providing the respective dye layers of three colors of yellow, magenta, and cyan, and the heat-transferable protective layer in area order, and the heat-sensitive transfer sheet provided with the white layer may be combined. In this case, the heat transferable protective layer is formed on the receptor layer, and the white layer is transferred onto this heat transferable protective layer.

Herein, it is preferable for all of the heat-sensitive transfer sheets to have a heat resistant lubricating layer on the side of the support opposite to the side on which the dye layer, white layer or heat-transferable protective layer is provided.

[Support]

Conventionally known supports can be used as the support. For example, a polyamide film, a polyimide film, and a polyester film are exemplified. Among them, a polyester film is preferable, and examples of the polyester film include polyethylene terephthalate (PET) and polyethylene naphthalate (PEN), and polyethylene terephthalate is preferable.

The thickness of the support can be properly determined in accordance with the material of the support so that the strength, the heat resistance, and the like become appropriate. Specifically, it is preferable to use a support having a thickness of 1 μm to 100 μm, more preferably approximately from 2 μm to 50 μm, and further preferably approximately from 3 μm to 10 μm.

[Dye Layer (Colorant Layer)]

(Binder Resin)

Examples of the binder resin used in the dye layer include acrylic resins such as polyacrylonitrile, polyacrylate, and polyacrylamide; polyvinyl acetal-series resins such as polyvinyl acetoacetal and polyvinyl butyral; cellulose-series resins such as ethylcellulose, hydroxyethylcellulose, ethylhydroxycellulose, hydroxypropylcellulose, ethylhydroxyethylcellulose, methylcellulose, cellulose acetate, cellulose acetate butyrate, cellulose acetate propionate, cellulose nitrate, other modified cellulose resins, nitrocellulose, and ethylhydroxyethylcellulose; other resins such as polyurethane resin, polyamide resin, polyester resin, polycarbonate resin, phenoxy resin, phenol resin, and epoxy resin; and various elastomers. These may be used alone, or two or more kinds thereof may be used in the form of a mixture or copolymer thereof.

(Dye)

The dye is not particularly limited, as long as it is able to diffuse by heat and able to be incorporated in the heat-sensitive transfer sheet, and able to transfer by heat from the heat-sensitive transfer sheet to the image-receiving sheet. As the dye used for the heat-sensitive transfer sheet, ordinarily used dyes or known dyes can be used.

Preferable examples of the dye include diarylmethane-series dyes, triarylmethane-series dyes, thiazole-series dyes, methine-series dyes such as merocyanine; azomethine-series dyes typically exemplified by indoaniline, acetophenoneazomethine, pyrazoloazomethine, imidazole azomethine, imidazo azomethine, and pyridone azomethine; xanthene-series dyes; oxazine-series dyes; cyanomethylene-series dyes typically exemplified by dicyanostyrene, and tricyanostyrene; thiazine-series dyes; azine-series dyes; acridine-series dyes; benzene azo-series dyes; azo-series dyes such as pyridone azo, thiophene azo, isothiazole azo, pyrrol azo, pyralazo, imidazole azo, thiadiazole azo, triazole azo, and disazo; spiropyran-series dyes; indolinospiropyran-series dyes; fluoran-series dyes; rhodaminelactam-series dyes; naphthoquinone-series dyes; anthraquinone-series dyes; and quinophthalon-series dyes.

Specific examples of a yellow dye that can be used in the present invention include Disperse Yellow 231, Disperse Yellow 201 and Solvent Yellow 93. Specific examples of a magenta dye that can be used in the present invention include Disperse Violet 26, Disperse Red 60, and Solvent Red 19. Specific examples of a cyan dye that can be used in the present invention include Solvent Blue 63, Solvent Blue 36, Disperse Blue 354 and Disperse Blue 35. The dye used in the present invention is not limited thereto. Further, dyes each having a different hue from each other as described above may be arbitrarily combined together.

In the heat-sensitive transfer sheet, it is possible to dispose a dye barrier layer between the dye layer and the support.

The surface of the support may be subjected to treatment for easy adhesion to improve wettability and an adhesive property of the coating liquid. Examples of the treatment include known resin surface modifying techniques such as corona discharge treatment, flame treatment, ozone treatment, ultraviolet treatment, radial ray treatment, surface-roughening treatment, chemical agent treatment, vacuum plasma treatment, atmospheric plasma treatment, primer treatment, grafting treatment, and the like.

An easy adhesion layer (easily-adhesive layer) may be formed on the support by coating. Examples of a resin used in the easily-adhesive layer include polyester-series resins, polyacrylate-series resins, polyvinyl acetate-series resins, vinyl-series resins such as polyvinyl chloride resin and polyvinyl alcohol resin, polyvinyl acetal-series resins such as polyvinyl acetoacetal and polyvinyl butyral, polyether-series resins, polyurethane-series resins, styrene acrylate-series resins, polyacrylamide-series resins, polyamide-series resins, polystyrene-series resins, polyethylene-series resins, and polypropylene-series resins.

When the film (layer) used for the support is formed by melt extrusion, it is allowable to subject a non-stretched film to coating treatment followed by stretching treatment.

The above-mentioned treatments may be used in combination of two or more thereof.

[White Layer (White Transfer Layer)]

The white layer used in the heat-sensitive transfer sheet is constituted to include a white pigment to impart appropriate white concealability and light diffusibility to a printed material after transfer, and a binder resin. It is preferable to provide a peeling layer between the white layer and the support. Furthermore, an adhesive layer may be provided on the white layer. Herein, in the case where the white layer is transferred onto a pseudo-image without being mediated by the adhesive layer, a conventionally known binder resin having adhesiveness may be used, or an adhesive may be incorporated into the white layer. As the white pigment, typical white pigments as well as filler can be used. Therefore, the white pigment as used herein includes filler.

The white pigments are hard solid particles, and examples thereof include white pigments such as titanium oxide or zinc oxide; inorganic fillers such as silica, alumina, clay, talc, calcium carbonate, or barium sulfate; and resin particles (plastic pigments) such as an acrylic resin, an epoxy resin, a polyurethane resin, a phenol resin, a melamine resin, a benzoguanamine resin, a fluororesin, or a silicone resin. Titanium oxide includes rutile-type titanium oxide and anatase-type titanium oxide, but any of them may be used.

Any conventionally known binder resin can be used, but preferred examples include an acrylic resin, a cellulose-series resin, a polyester-series resin, a vinyl-series resin, a polyurethane-series resin, a polycarbonate-series resin, and partially crosslinked resins thereof.

To the white layer, a fluorescent whitening agent can be added, in addition to the white pigment and the binder resin. Known compounds having a fluorescent whitening effect, such as a stilbenzene-series compound and a pyrazoline-series compound, can be used as the fluorescent whitening agent. Further, a small amount of colorant may also be incorporated into the white layer.

The white layer is such that when a lenticular lens sheet printed material to which the white layer has been transferred is viewed under a transmitted light coming from a backlight, the white layer needs to have appropriate light diffusibility and light transmissibility. On the other hand, when the lenticular lens sheet printed material to which the white layer has been transferred is viewed under a reflected light coming from the front direction, the white layer needs to have appropriate light diffusibility and light reflectability. In the case of the latter, the total light ray transmittance of the white layer after transfer is preferably 60% or less, and particularly in the case of forming pseudo-images which may serve as a continuous image, the total light ray transmittance is preferably 50% or less.

In order to adjust the total light ray transmittance of the white layer after transfer to 60% or less and thereby to impart sufficient white concealability, it is preferable to set the ratio of a binder resin (A) and a white pigment (B) that constitute the white layer, within the range of A/B=1/1 to 1/10. It is particularly preferable to set the lower limit of this amount ratio at 1/1.5, and the upper limit at 1/6. The ratio of A/B is appropriately set in the range described above, depending on the material of the support sheet having a lenticular lens to which the white layer is transferred or the material of the receptor layer. If the ratio A/B is too large, the total light transmittance may exceed 60%, and the white concealability may be decreased. If the white pigment is incorporated in a large amount and the ratio A/B is too small, film coatability deteriorates. Thus, abrasion properties may be deteriorated, or adhesiveness may be deteriorated due to the decrease of the resin content.

The thickness of the white layer is adjusted to approximately 0.5 to 10 μm.

Measurement of the total light ray transmittance is carried out as stipulated in JIS K 7105. An excellent printed material can be formed by setting up the ratio A/B and the thickness of the white layer such that the total light ray transmittance of the white layer transfer section of the heat-sensitive transfer sheet is 60% or less, and preferably 50% or less.

[Peeling Layer]

The peeling layer used in the heat-sensitive transfer sheet constitutes a white layer transfer section together with the white layer, and is formed between the support film and the white layer. The peeling layer is provided to prevent fusion between the heat-sensitive transfer sheet and the lenticular lens sheet, and to facilitate the transfer of the white layer on the receptor layer provided on the lenticular lens sheet without causing any transfer unevenness.

As the peeling layer, for example, a releasable peeling layer that separates from the interface between the peeling layer and the base film (support), or a cohesive peeling layer that causes cohesion failure within the peeling layer and thereby separates from the base film, can be formed.

The releasable peeling layer can be constructed by adding a releasable material to the binder resin, according to the necessity. Examples of the binder resin that can be used include thermoplastic resins, for example, acrylic resins such as polymethyl methacrylate, polyethyl methacrylate and polybutyl acrylate; vinyl-series resins such as polyvinyl acetate, vinyl chloride-vinyl acetate copolymers, polyvinyl alcohol, and polyvinyl butyral; and cellulose derivatives such as ethyl cellulose, nitrocellulose, and cellulose acetate; or thermosetting resins, for example, unsaturated polyester resins, polyester resins, polyurethane-series resins, aminoalkyd resins, and the like. The releasable peeling layer can be constructed from a composition composed of one kind or two or more kinds of these resins.

Examples of the releasable material include resins having releasability, such as waxes, silicone waxes, silicone oils, silicone-series resins, melamine resins, and fluororesins; lubricants such as talc, silica microparticles, surfactants, and metal soaps; and the like.

The releasable peeling layer can also be constructed from a resin having releasability. In this case, a silicone-series resin, a melamine resin, a fluororesin, and the like can be used, and a graft polymer produced by grafting a releasable segment such as a polysiloxane segment and a fluorinated carbon segment into the molecule of a resin such as an acrylic resin, a vinyl-series resin, and a polyester resin may be used as well. The releasable peeling layer can also be constructed from a composition containing one kind or two or more kinds of the resins mentioned above. The releasable peeling layer may further contain, in addition to the materials described above, a conventionally known fluorescent whitening agent having an effect of a fluorescent whitening of image, such as a stilbenzene-series compound and a pyrazoline-series compound.

The cohesive failing peeling layer causes so-called cohesive failure in the middle part of the peeling layer in the thickness direction when the white layer transfer section is transferred onto the receptor layer, and a portion of the peeling layer remains on the base film without being peeled off, and the other portion is transferred onto the printed material. When the cohesive failing peeling layer peels off and migrates onto the lenticular lens sheet, the concavo-convex shape of the cohesively failed surface is formed on the uppermost surface of the printed material. For example, in the case where the printed material is viewed under a transmitted light coming from a backlight, the concavo-convex formed on the uppermost surface of the printed material diffuses and reflects the illuminated light. This supplements the light diffusibility of the white layer, and thus a printed material with good visual quality, which has both satisfactory light diffusibility and light transmissibility, can be formed.

As materials for forming the cohesive failing peeling layer, a binder resin and a releasable material that is added according to the necessary are used. Examples of the binder resin that can be used include one kind or two or more kinds of resins selected from thermoplastic resins, for example, acrylic resins such as polymethyl methacrylate, polyethyl methacrylate and polybutyl acrylate; vinyl-series resins such as polyvinyl acetate, vinyl chloride-vinyl acetate copolymers, polyvinyl alcohol, and polyvinyl butyral; cellulose derivatives such as ethyl cellulose, nitrocellulose, and cellulose acetate; polyester resins, polyurethane resins, and the like. It is preferable that these binder resins include a resin having a Tg of 100° C. or a softening point of 100° C. or higher, so as to prevent fusion with the support sheet at the time of heat transfer. Further, a resin having a Tg of below 100° C. or a softening point of below 100° C. can also be used, if combined with an appropriate releasable material.

Examples of the releasable material that can be used include waxes, inorganic microparticles such as talc, silica and the like, and organic microparticles. The releasable material is preferably added in an amount of 0.1 to 200% by mass, and more preferably 10 to 100% by mass, relative to the amount of the binder resin.

In the case where the releasable material is not used in the cohesive failing peeling layer, two or more kinds of resins that have low compatibility with each other among the binder resins mentioned above can be used, so that the peeling layer can be peeled off at the interface between the binder resins that form the peeling layer.

The white concealability of the printed material can be enhanced by incorporating a white pigment into the peeling layer. For example, in the case where the white concealability is insufficient, a printed material having sufficient white concealability can be obtained by incorporating the white pigment into the white layer as well as the peeling layer, and thereby adjusting the total light ray transmittance of the white layer and the peeling layer to 60% or less.

In the case where it is wished to impart adhesiveness to the white layer, or to enhance adhesiveness of the white layer, an adhesive binder resin can be incorporated into the white layer. However, in this case, the proportion of the white pigment is correspondingly decreased, and the white concealability may become insufficient. In order to supplement such white concealability of the white layer, the white pigment can be incorporated into the peeling layer, and thus a printed material having sufficient white concealability can be obtained.

As the white pigment contained in the peeling layer, titanium oxide, zinc oxide or the like can be used as described above. The content of the white pigment cannot be defined in a simple manner since the content is defined on the basis of the relationship with the white concealability of the white layer. However, in the case where the white pigment is added to the peeling layer, the addition amount is generally 100 to 500% by mass, the upper limit is preferably approximately 300% by mass, and the lower limit is approximately 200% by mass, to the amount of the binder resin that constitutes the peeling layer.

The releasable or cohesive failing peeling layer as discussed above may also be added with an ultraviolet absorbent, an antioxidizing agent, a fluorescent whitening agent (stilbenzene-series, pyrazoline-series compound, and the like) and the like, for enhancing the weather resistance performance, in addition to the materials described above.

The peeling layer can be formed by the same method as that used for the dye layer, and the thickness of the peeling layer is preferably 0.1 to 5.0 μm as obtained after coating and drying.

As the white layer and the peeling layer, those layers described in Japanese Patent No. 3789033 are preferably used.

[Adhesive Layer]

An adhesive layer may be provided on the white layer. A preferably applicable adhesive layer is the adhesive layer for the heat transferable protective layer.

[Heat Resistant Lubricating Layer]

In the heat-sensitive transfer sheet, it is preferred to dispose a heat-resistant lubricating layer (back side layer) on the surface (back side) of the support opposite to the surface on which the dye layer is formed, namely on the side of the support with which a thermal head and the like contact. Further, in the case of a white layer transfer sheet and protective layer transfer sheet, it is also preferred to dispose the heat-resistant lubricating layer on the side of the support with which the thermal head and the like contact.

If the heat-sensitive transfer sheet is heated by a heating device such as a thermal head in the state such that the back side of the support of the heat-sensitive transfer sheet directly contacts with the heating device, thermal fusion bonding is apt to occur. In addition, owing to a large friction between them, it is difficult to smoothly transfer the heat-sensitive transfer sheet at the time of printing.

The back side layer is disposed so as to enable the heat-sensitive transfer sheet to withstand heat energy from the thermal head. The heat-resistant lubricating layer prevents the thermal fusion bonding, and enables a smooth travel action. Recently, the necessity of the heat-resistant lubricating layer becomes large on account that the heat energy from the thermal head increases in association with speeding-up of the printer.

The heat-resistant lubricating layer is formed by coating a binder to which a sliding agent, a release agent, a surfactant, inorganic particles, organic particles, pigments, and the like are added. Further, an intermediate layer may be disposed between the back side layer and the support. As the intermediate layer, there has been known a layer containing inorganic fine particles and a water-soluble resin or a hydrophilic resin capable of emulsification.

As the binder, a known resin having high heat-resistance may be used. Examples thereof include cellulose resins such as ethylcellulose, hydroxycellulose, hydroxypropylcellulose, methylcellulose, cellulose acetate, cellulose acetate butyrate, cellulose acetate propionate, and nitrocellulose; vinyl-series resins such as polyvinyl alcohol, polyvinyl acetate, polyvinyl butyral, polyvinyl acetal, polyvinyl acetoacetal resin, vinyl chloride-vinyl acetal copolymer, and polyvinyl pyrrolidone; acrylic resins such as methyl polymethacrylate, ethyl polyacrylate, polyacrylamide, and acrylonitrile-styrene copolymer; and natural or synthetic resins such as polyamide resin, polyimide resin, polyamideimide resin, polyvinyl toluene resin, coumarone indene resin, polyester-series resin, polyurethane resin, polyether resin, polybutadiene resin, polycarbonate resin, chlorinated polyolefin resin, fluorine-contained resin, epoxy resin, phenol resin, silicone resin, silicone-modified or fluorine-modified urethane. These may be used alone or in the mixture thereof.

In order to enhance heat resistance of the heat-resistant lubricating layer, there have been known techniques of cross-linking resins by ultraviolet ray or electron beam radiation. Further, the resin may be cross-linked by heating with a cross-linking agent. According to need, a catalyst may be added to the resin. As the exemplary cross-linking agent, polyisocyanate and the like are known. When the polyisocyanate is used, a resin with a hydroxyl group-based functional group is suited to be cross-linked. JP-A-62-259889 discloses a back side layer formed of a reaction product of polyvinyl butyral and an isocyanate compound, to which a bulking agent such as an alkali metal salt or alkaline earth metal salt of phosphoric ester and potassium carbonate is added. JP-A-6-99671 discloses that a heat resistant lubricating layer-forming high molecular compound can be obtained by reacting a silicone compound having an amino group and an isocyanate compound having two or more isocyanate groups in one molecule.

In order to sufficiently exhibit the function, the back side layer may be incorporated with additives such as a sliding agent, a plasticizer, a stabilizer, a bulking agent, and a filler for removing materials adhered to the head.

Examples of the sliding agent include fluorides such as calcium fluoride, barium fluoride, and graphite fluoride; sulfides such as molybdenum disulfide, tungsten disulfide, and iron sulfide; oxides such as lead oxide, alumina, and molybdenum oxide; solid sliding agents composed of inorganic compounds such as graphite, mica, boron nitride, and clays (e.g., talc, acid white clay); organic resins such as fluorine resins and silicone resins; silicone oil; metal soaps such as metal salt of stearic acid; various kinds of waxes such as polyethylene wax and paraffin wax; and surfactants such as anionic surfactants, cationic surfactants, amphoteric surfactants, nonionic surfactants, and fluorine-containing surfactants.

Phosphoric ester surfactants such as zinc salt of alkyl phosphoric monoester or alkyl phosphoric diester may be used. However, the acid group of the phosphate causes a disadvantage such that the phosphate decomposes as a heat quantity from a thermal head becomes large, and consequently the pH of the back side layer reduces, corrosive abrasion of the thermal head becomes heavy. As a measure to deal with the disadvantage, there are known, for example, a method of using a neutralized phosphate-series surfactant, and a method of using a neutralizing agent such as magnesium hydroxide.

Examples of the other additives include higher fatty acid alcohols, organopolysiloxane, organic carboxylic acids and derivatives thereof, and fine particles of inorganic compounds such as talc and silica.

The heat-resistant lubricating layer is formed by adding additives to the binder exemplified above, dissolving or dispersing the resultant into a solvent to prepare a coating liquid, and then applying the coating liquid by a known method such as gravure coating, roll coating, blade coating, or wire bar coating. The film thickness of the heat-resistant lubricating layer is preferably approximately from 0.1 to 10 μm, more preferably approximately from 0.5 to 5 μm.

<Image-Forming Method>

In the image-forming method using the heat-sensitive transfer image-receiving sheet of the present invention, an image is formed by superposing the heat-sensitive transfer sheet on the heat-sensitive transfer image-receiving sheet of the present invention so that the dye layer (colorant layer) of the heat-sensitive transfer sheet is in contact with the receptor layer of the heat-sensitive transfer image-receiving sheet, and giving thermal energy in accordance with image signals given from the thermal head. Specifically, an image-forming may be conducted in the same manner as that described in, for example, JP-A-2005-88545.

In regard to stereoscopic images, it is necessary to print the image at a precise position in accordance with the concavo-convex of the lenticular lens. In connection with this method, the method described in Japanese Patent No. 3609065 or the like can be used.

The present invention is contemplated for providing a method of producing a heat-sensitive transfer image receiving sheet, which can stably print a high-quality three-dimensional image with a small number of transfer defect at the time of printing.

The present invention can provide a method of producing a heat-sensitive transfer image receiving sheet, which can stably print a high-quality three-dimensional image with a small number of transfer defect at the time of printing.

EXAMPLES

The present invention will be described in more detail based on the following examples. Any materials, reagents, amount and ratio of use and operations, as shown in the examples, may appropriately be modified without departing from the spirit and scope of the present invention. It is therefore understood that the present invention is by no means intended to be limited to the specific examples below. In the following Examples, the terms "part" and "%" are values by mass, unless they are indicated differently in particular.

Example 1

(Synthesis of Polyether-Modified Silicone)

Synthesis of the polyether-modified silicone represented by formula (S1) used in the present invention can be carried out using the known methods described in Kunio Itoh, "Silicone Handbook" (Nikkan Kogyo Shimbun Co., Ltd., 1990, p. 163) and the like.

Specifically, in a glass flask equipped with a stirring device and a thermometer, 20 parts by mass of a dimethylsiloxane-methyl hydrogen siloxane copolymer represented by the average structural formula (1):

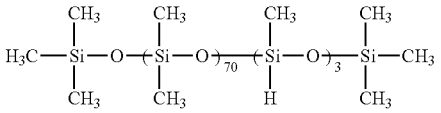

and 40 parts by mass of a single-terminal allyl etherified polyoxyalkylene represented by the average structural formula (2): $CH_2{=}CHCH_2O(C_2H_4O)_{20}(C_3H_6O)_{20}CH_3$ were mixed, and 20 parts by mass of isopropyl alcohol was added as a solvent. Furthermore, chloroplatinic acid was added thereto. After the mixture was stirred for 2 hours at 86° C., it was confirmed that the peak representing Si—H in the infrared absorption spectrum disappeared. The mixture was further stirred for 30 minutes. The reaction liquid was concentrated under reduced pressure, and thereby a polyether-modified silicone S1-1 shown in Table 1 below was obtained.

A polyether-modified silicone S1-2 shown in Table 1 below was obtained in the same manner as the polyether-modified silicone S1-1, except that the structure of the single-terminal allyl etherified polyoxyalkylene was changed to the average structural formula (3): $CH_2{=}CHCH_2O(C_2H_4O)_{35}CH_3$.

A polyether-modified silicone S1-3 shown in Table 1 below was obtained in the same manner as the polyether-modified silicone S1-1, except that the structure of the single-terminal allyl etherified polyoxyalkylene was changed to the average structural formula (4): $CH_2{=}CHCH_2O(C_2H_4O)_{10}CH_3$.

A polyether-modified silicone S1-4 shown in Table 1 below was obtained in the same manner as the polyether-modified silicone S1-1, except that the structure of the single-terminal allyl etherified polyoxyalkylene was changed to the average structural formula (5): $CH_2{=}CHCH_2O(C_2H_4O)_{50}(C_3H_6O)_{50}CH_3$.

A polyether-modified silicone S1-5 shown in Table 1 below was obtained in the same manner as the polyether-modified silicone S1-1, except that the structure of the single-terminal allyl etherified polyoxyalkylene was changed to the average structural formula (6): $CH_2{=}CHCH_2O(C_2H_4O)_{40}(C_3H_6O)_{35}CH_3$.

TABLE 1

| Polyether-modified silicone | a1 | b1 |
|---|---|---|
| Polyether-modified silicone S1-1 | 20 | 20 |
| Polyether-modified silicone S1-2 | 35 | 0 |
| Polyether-modified silicone S1-3 | 10 | 0 |
| Polyether-modified silicone S1-4 | 50 | 50 |
| Polyether-modified silicone S1-5 | 40 | 35 |

Receptor Layer Coating Liquid 1

| | |
|---|---|
| Vinyl chloride/acrylic copolymer latex (trade name: Vinybran 900, manufactured by Nissin Chemical Industry Co., Ltd., solid content: 40%, glass transition temperature: 70° C.) | 20.0 mass parts |
| Vinyl chloride/acrylic copolymer latex (trade name: Vinybran 690, manufactured by Nissin Chemical Industry Co., Ltd., solid content: 55%, glass transition temperature: 46° C.) | 20.0 mass parts |
| Weighted average glass transition temperature: 56° C. | |
| Polyvinylpyrrolidone (trade name: K-90, manufactured by ISP Japan Ltd.) | 0.5 mass part |
| The above-described polyether-modified silicone S1-4 (100%) | 1.5 mass parts |
| Anionic surfactant A1-1 | 0.5 mass part |
| Water | 52.0 mass parts |

(Production of Sample 101)

A sample 101 was produced by the following procedure.

(1) A biaxially stretched polyethylene terephthalate (PET) film (manufactured by Fujifilm Corp.) having the thickness of 188 μm was used as a transparent support, and the PET film (thickness 188 μm) which was running at a rate of 10 m/min was inserted between a mirror-surface roller (ϕ 350 mm, surface temperature 15° C.) and a nip roller. A glycol-modified polyethylene terephthalate resin PETG (manufactured by SK Chemicals Co., Ltd) and an adhesive resin (trade name: ADMER, manufactured by Mitsui Chemicals, Inc.) were co-extruded from a T-die (ejection width 350 mm) set up at a temperature of 280° C., at a measured resin temperature of 260 to 280° C., and were supplied between the PET film and the mirror-surface roller. Thus, a sheet having a subbing layer (thickness 220 μm) formed thereon was rolled up by a rolling step.

(2) The below-described receptor layer-coating liquid 1 was coated, so that the coating amount would be 2.5 g/m$^2$, on the subbing layer formed on the sheet having been web-transported according to the method exemplified by FIG. 9 described in U.S. Pat. No. 2,761,791, thereby providing a receptor layer coated on the subbing layer. After coating of the receptor layer, drying was carried out in three drying zones (first zone, second zone, third zone). The drying conditions in these zones were set as follows:

First zone: temperature: 80° C.; transit time: 12 seconds; speed of wind: about 3 m/sec;

Second zone: temperature: 80° C.; transit time: 12 seconds; speed of wind: about 3 m/sec; and Third zone: temperature: 120° C.; transit time: 12 seconds; speed of wind: about 5 m/sec.

(3) The resin sheet provided with the subbing layer and the receptor layer thereon was wound off at a rate of 10 m/min in a conveyance step, and was inserted between an embossed roller (ϕ 350 mm, 40° C.) having a lenticular lens shape (radius 150 μm, lens height 70 μm, pitch 254 μm) and a nip roller. A glycol-modified polyethylene terephthalate resin PETG (manufactured by SK Chemicals Co., Ltd.) and the adhesive resin (trade name: ADMER, manufactured by Mitsui Chemicals Inc.) were co-extruded from a T-die (ejection width 330 mm) set up at a temperature of 280° C., at a measured resin temperature of 260 to 280° C., and were supplied between the resin sheet and the embossed roller to be laminated. Thus, a lenticular sheet (thickness 340 μm) could be obtained.

(Production of Samples 102 to 109)

Samples 102 to 109 were produced in the same manner as in sample 101, except that the receptor layer-coating liquid and the drying temperature in sample 101 were changed to those described in the following Table 2.

Receptor Layer Coating Liquid 2

| | |
|---|---|
| Vinyl chloride/acrylic copolymer latex (trade name: Vinybran 900, manufactured by Nissin Chemical Industry Co., Ltd., solid content: 40%, glass transition temperature: 70° C.) | 47.5 mass parts |
| Polyvinylpyrrolidone (trade name: K-90, manufactured by ISP Japan Ltd.) | 0.5 mass part |
| The above-described polyether-modified silicone S1-4 (100%) | 1.5 mass parts |
| Anionic surfactant A1-1 | 0.5 mass part |
| Water | 44.5 mass parts |

Receptor Layer Coating Liquid 3

| | |
|---|---|
| Polyester latex (trade name: VYLONAL MD1100, manufactured by Toyobo Co., Ltd., solid content: 30%, glass transition temperature: 40° C.) | 63.0 mass parts |
| Polyvinylpyrrolidone (trade name: K-90, manufactured by ISP Japan Ltd.) | 0.5 mass part |
| The above-described polyether-modified silicone S1-4 (100%) | 1.5 mass parts |
| Anionic surfactant A1-1 | 0.5 mass part |
| Water | 39.0 mass parts |

(Production of Samples 110 and 111)

Samples 110 and 111 were produced in the same manner as the sample 101, except that the glycol-modified polyethylene terephthalate (PETG) resin used in the subbing layer and the lenticular lens was changed to a polyethylene (PE) resin or the like as indicated in Table 2 shown below.

When a polycarbonate resin (trade name: EUPIRON E-200, manufactured by Mitsubishi Engineering-Plastics Corporation) was used, the T-die temperature was set up at 320 to 330° C., and the measured resin temperature was adjusted to 290 to 330° C. Furthermore, when a polyethylene resin (trade name: SUMIKA SEN L405, manufactured by Sumitomo Chemical Co., Ltd.) was used, the T-die temperature was set up at 290° C., and the measured resin temperature was adjusted to 270 to 290° C.

TABLE 2

| | Lenticular layer | | Subbing layer | | | Drying temperature | | | |
|---|---|---|---|---|---|---|---|---|---|
| Sample No. | Upper layer | Lower layer | Upper layer | Lower layer | Receptor layer coating liquid (Glass transition temperature) | First zone | Second zone | Third zone | Remarks |
| 101 | PETG | ADMER | PETG | ADMER | Receptor layer coating liquid 1 (56° C.) | 80° C. | 80° C. | 120° C. | This invention |
| 102 | PETG | ADMER | PETG | ADMER | Receptor layer coating liquid 1 (56° C.) | 80° C. | 80° C. | 90° C. | This invention |
| 103 | PETG | ADMER | PETG | ADMER | Receptor layer coating liquid 1 (56° C.) | 80° C. | 80° C. | 80° C. | Comparative example |
| 104 | PETG | ADMER | PETG | ADMER | Receptor layer coating liquid 2 (70° C.) | 80° C. | 80° C. | 120° C. | This invention |
| 105 | PETG | ADMER | PETG | ADMER | Receptor layer coating liquid 2 (70° C.) | 80° C. | 80° C. | 100° C. | This invention |
| 106 | PETG | ADMER | PETG | ADMER | Receptor layer coating liquid 2 (70° C.) | 80° C. | 80° C. | 90° C. | Comparative example |
| 107 | PETG | ADMER | PETG | ADMER | Receptor layer coating liquid 3 (40° C.) | 60° C. | 60° C. | 100° C. | This invention |
| 108 | PETG | ADMER | PETG | ADMER | Receptor layer coating liquid 3 (40° C.) | 60° C. | 60° C. | 70° C. | This invention |
| 109 | PETG | ADMER | PETG | ADMER | Receptor layer coating liquid 3 (40° C.) | 60° C. | 60° C. | 60° C. | Comparative example |
| 110 | PETG | ADMER | PE | ADMER | Receptor layer coating liquid 1 (56° C.) | 80° C. | 80° C. | 120° C. | This invention |
| 111 | PETG | ADMER | PC | ADMER | Receptor layer coating liquid 1 (56° C.) | 80° C. | 80° C. | 120° C. | This invention |

(Production of Heat-Sensitive Transfer Sheet)

A polyester film having the thickness of 6.0 μm (trade name: Diafoil K200E-6F, manufactured by MITSUBISHI POLYESTER FILM CORPORATION), that was subjected to an easy-adhesion-treatment on one surface of the film, was used as a support. The following heat resistant lubricating layer coating liquid was applied on the other surface of the support that was not subjected to the easy-adhesion-treatment, so that the coating amount based on the solid content after drying would be 1 g/m$^2$. After drying, the coating liquid was cured by heat at 60° C.

Coating liquids, which will be detailed later, were used to form, onto the easily-adhesive layer coated surface of the thus-formed polyester film, individual dye layers in yellow, magenta and cyan in area order by coating. In this way, a heat-sensitive transfer sheet was produced. The solid coating amount in each of the dye layers was set to 0.8 g/m$^2$.

Coating Liquid for Heat Resistant Lubricating Layer

| | |
|---|---|
| Acrylic-series polyol resin (trade name: ACRYDIC A-801, manufactured by Dainippon Ink and Chemicals, Incorporated) | 26.0 mass parts |
| Zinc stearate (trade name: SZ-2000, manufactured by Sakai Chemical Industry Co., Ltd.) | 0.43 mass part |
| Phosphate (trade name: PLYSURF A217, manufactured by Dai-ichi Kogyo Seiyaku Co., Ltd.) | 1.27 mass parts |
| Isocyanate (50% solution) (trade name: BURNOCK D-800, manufactured by Dainippon Ink and Chemicals, Incorporated) | 8.0 mass parts |
| Methyl ethyl ketone/toluene (2/1, at mass ratio) | 64 mass parts |

Yellow-Dye-Coating Liquid

| | |
|---|---|
| The following yellow dye | 7.8 mass parts |
| Polyvinylacetal resin (trade name: S-LEC KS-1, manufactured by Sekisui Chemical Co., Ltd.) | 6.1 mass parts |

-continued

| | |
|---|---|
| Polyvinylbutyral resin(trade name: DENKA BUTYRAL #6000-C, manufactured by DENKI KAGAKU KOGYOU K. K.) | 2.1 mass parts |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/toluene (2/1, at mass ratio) | 84 mass parts |

Magenta-Dye-Coating Liquid

| | |
|---|---|
| The following magenta dye | 7.8 mass parts |
| Polyvinylacetal resin (trade name: S-LEC KS-1, manufactured by Sekisui Chemical Co., Ltd.) | 8.0 mass parts |
| Polyvinylbutyral resin(trade name: DENKA BUTYRAL #6000-C, manufactured by DENKI KAGAKU KOGYOU K. K.) | 0.2 mass part |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/toluene (2/1, at mass ratio) | 84 mass parts |

Cyan-Dye-Layer-Coating Liquid

| | |
|---|---|
| The following cyan dye | 7.8 mass parts |
| Polyvinylacetal resin (trade name: S-LEC KS-1, manufactured by Sekisui Chemical Co., Ltd.) | 7.4 mass parts |
| Polyvinylbutyral resin (trade name: DENKA BUTYRAL #6000-C, manufactured by DENKI KAGAKU KOGYOU K. K.) | 0.8 mass part |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/toluene (2/1, at mass ratio) | 84 mass parts |

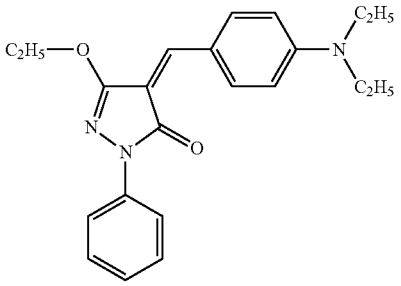

Yellow dye

-continued

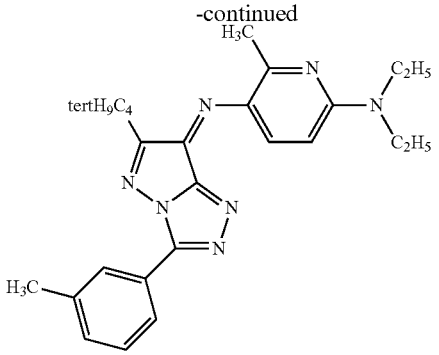

Magenta dye

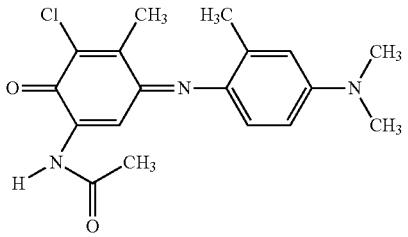

Cyan dye

A transferable white layer laminate was formed by applying a peeling layer coating liquid and a white layer coating liquid having compositions as shown below on the same polyester film as that used in the production of the dye layer, according to the method described in Japanese Patent No. 3789033. The coating amount at the time of film drying was set at 0.6 g/m$^2$ for the peeling layer and 2.0 g/m$^2$ for the white layer.

Coating Liquid for Peeling Layer

| | |
|---|---|
| Acrylic resin (trade name: LP-45M, manufactured by Soken Chemical & Engineering Co., Ltd.) | 16 mass parts |
| Polyethylene wax (average particle size: about 1.1 μm) | 8 mass parts |
| Toluene | 76 mass parts |

Coating Liquid for White Layer

| | |
|---|---|
| Modified acrylic resin (trade name: ACRYDICK BZ-1160, manufactured by Dainippon Ink and Chemicals, Incorporated) | 20 mass parts |
| Anatase-type titanium oxide (trade name: TCA888, manufactured by Tochem Products Co., Ltd.) | 40 mass parts |
| Fluorescent whitening agent (trade name: UVITEX OB, manufactured by Ciba-Geigy Corp.) | 0.3 mass part |
| Toluene/isopropyl alcohol (1/1, at mass ratio) | 40 mass parts |

(Image Forming Method)

In the printer for forming images, a thermal head having a heater length of 42 μm was used according to the method described in, for example, JP-A-2000-94729. Images were output under the setup condition in which gray gradation was able to be obtained all over the range of from the lowest density to the highest density. Further, for three-dimensional images, six-view images were printed onto a lens with 100 Lpi pitch. Further, printing was carried out at an atmosphere of temperature 35° C. and relative humidity 85%, at which transfer failure may easily occur.

(Evaluation of Dmax)

The visual density of the black image obtained in the above condition was measured by Photographic Densitometer (trade name, manufactured by X-Rite Incorporated).

(Evaluation of Transfer Failure)

Twenty sheets of 2 L-sized gray image throughout the range of from the minimum density to the maximum density were continuously printed. All of transfer failures were counted.

Score 5: number of transfer failure is less than 5.

Score 4: number of transfer failure is 5 or more and less than 10.

Score 3: number of transfer failure is 10 or more and less than 20.

Score 2: number of transfer failure is 20 or more and less than 30.

Score 1: number of transfer failure is are 30 or more.

(Evaluation of Shift of Register in Color Printing)

With respect to each sample, twenty copies of a 2 L-size image in which the black image at the above-described Dmax portion and a white image are equally shared were continuously printed. A level of shift of the register in the color printing on the print was visually evaluated.

Score 5: there was no image which caused a shift of the register in the color printing.

Score 4: a copy number of the image which caused a shift of the register in the color printing was less than 3.

Score 3: a copy number of the image which caused a shift of the register in the color printing was 3 or more and 5 or less.

Score 2: a copy number of the image which caused a shift of the register in the color printing was 5 or more and 10 or less.

Score 1: a copy number of the image which caused a shift of the register in the color printing was 10 or more.

The obtained results are shown in Table 3 below.

The heat-sensitive transfer image-receiving sheet of the present invention, namely, the samples 101, 102, 104, 105, 107, 108, 110 and 111 had fewer transfer failures, and exhibited remarkable effects, as compared with the heat-sensitive transfer image-receiving sheets 103, 106 and 109 of the comparative examples. It could be seen that a high Dmax effect was obtained by using a vinyl chloride/acrylic copolymer as a latex polymer in the receptor layer.

It could be seen that a stable image free from shift of color registration could be obtained in samples in which the same resin as that of the lenticular lens was used as the subbing layer.

TABLE 3

| Sample No. | Evaluation of shift of register in color printing | Evaluation of transfer failure | Dmax | Remarks |
|---|---|---|---|---|
| 101 | 5 | 5 | 2.08 | This invention |
| 102 | 5 | 4 | 2.08 | This invention |
| 103 | 5 | 2 | 2.06 | Comparative example |
| 104 | 5 | 5 | 2.01 | This invention |
| 105 | 5 | 4 | 2.01 | This invention |
| 106 | 5 | 1 | 2.00 | Comparative example |
| 107 | 4 | 5 | 1.75 | This invention |
| 108 | 4 | 3 | 1.75 | This invention |
| 109 | 4 | 1 | 1.74 | Comparative example |
| 110 | 3 | 4 | 2.02 | This invention |
| 111 | 3 | 4 | 2.02 | This invention |

Example 2

Samples 201 to 203 were produced in the same manner as in samples 101 to 103 in Example 1, except that 2.0 parts by mass of gelatin (a 10% aqueous solution) was added to the receptor layer-coating liquid 1, and were subjected to the same evaluation as in Example 1. As a result, it could be seen that an effect of improvement to be obtained by the present invention was seen in samples 201 and 202 of the present invention; however the embodiment in which gelatin was not contained (samples 101 and 102) was more excellent in the effect of the present invention.

Example 3

Samples 301 to 304 were produced in the same manner as the sample 101, except that the polyether-modified silicone S1-4 of the receptor layer coating liquid 1 was changed to equal masses of S1-1, S1-2, S1-3 and S1-5, respectively, and the same evaluation as that performed in the Example 1 was carried out. As a result, although there were some variations in the extent of the effect, all of the samples were recognized to have improving effects on the transfer failure, the shift of the register in the color printing, and Dmax. Furthermore, a sample 305 was produced in the same manner as the sample 101, except that the polyether-modified silicone S1-4 was not used, and the same evaluation was carried out. Thus, it was confirmed that using the polyether-modified silicone represented by formula (S1) boosts up these effects.

Having described our invention as related to the present embodiments, it is our intention that the invention not be limited by any of the details of the description, unless otherwise specified, but rather be construed broadly within its spirit and scope as set out in the accompanying claims.

This application claims priority on Patent Application No. 2010-033840 filed in Japan on Feb. 18, 2009, which is entirely herein incorporated by reference.

What is claimed is:

1. A method of producing a heat-sensitive transfer image-receiving sheet, comprising the steps of:

conveying a transparent support by web handling;

providing at least one receptor layer on the transparent support; and drying the heat-sensitive transfer image-receiving sheet, wherein said at least one receptor layer contains a latex polymer having a weighted average glass transition temperature of 30° C. or more, wherein the heat-sensitive transfer image-receiving sheet is dried at a temperature that is higher than the weighted average glass transition temperature by 30° C. or more, wherein the heat-sensitive transfer image-receiving sheet has a lenticular lens on the side of the transparent support opposite to the side on which the receptor layer is provided;

wherein the heat-sensitive transfer image-receiving sheet is dried at a temperature within a range from the weighted average glass transfer temperature of the latex polymer to a temperature less than 30° C. lower than the weighted average glass transfer temperature of the latex polymer, and then dried at a temperature of at least 30° C. higher than the weighted average glass transfer temperature of the latex polymer.

2. The method of producing a heat-sensitive transfer image-receiving sheet according to claim 1, wherein at least one of the latex polymer is a polymer containing a vinyl chloride component as a polymer constituting component.

3. The method of producing a heat-sensitive transfer image-receiving sheet according to claim 1, wherein at least one of the latex polymer is a polyvinyl chloride or a vinyl chloride/acrylic copolymer.

4. The method of producing a heat-sensitive transfer image-receiving sheet according to claim 1, wherein the heat-sensitive transfer image-receiving sheet has a subbing layer which contains a resin that is identical with at least one resin constituting the lenticular lens, on the side of the transparent support opposite to the side on which the lenticular lens is provided, and wherein the heat-sensitive transfer image-receiving sheet has said at least one receptor layer on the subbing layer.

5. The method of producing a heat-sensitive transfer image-receiving sheet according to claim 1, wherein said at least one resin that constitutes the lenticular lens and/or the subbing layer is a polymethyl methacrylate resin, a polycarbonate resin, a polystyrene resin, a methacrylate-styrene copolymer resin, a polyethylene resin, a polyethylene terephthalate resin, or a glycol-modified polyethylene terephthalate resin.

6. The method of producing a heat-sensitive transfer image-receiving sheet according to claim 1, wherein the weighted average glass transition temperature of the latex polymer is 40° C. to 100° C.

7. The method of producing a heat-sensitive transfer image-receiving sheet according to claim 1, wherein the receptor layer contains two or more kinds of the latex polymer.

8. The method of producing a heat-sensitive transfer image-receiving sheet according to claim 1, wherein the receptor layer contains two or more kinds of the latex polymer, each of which is polyvinyl chloride or vinyl chloride/acrylic copolymer.

9. The method of producing a heat-sensitive transfer image-receiving sheet according to claim 1, wherein the receptor layer does not contain gelatin and polyvinyl alcohol.

10. The method of producing a heat-sensitive transfer image-receiving sheet according to claim 1, wherein the receptor layer contains the latex polymer and at least one polyether-modified silicone represented by formula (S1):

Formula (S1)

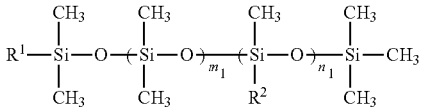

wherein $R^1$ represents an alkyl group; $R^2$ represents —X—$(C_2H_4O)_{a1}$—$(C_3H_6O)_{b1}$—$R^3$; $R^3$ represents a hydrogen atom, an acyl group, an alkyl group, a cycloalkyl group or an aryl group; X represents an alkylene group or an alkyleneoxy group; $m_1$ and $n_1$ each independently represents a positive integer; $a_1$ represents a positive integer; and $b_1$ represents 0 or a positive integer.

* * * * *